US012150505B2

(12) United States Patent
York et al.

(10) Patent No.: US 12,150,505 B2
(45) Date of Patent: Nov. 26, 2024

(54) PROTECTIVE COAT WITH RETRACTABLE COLLAR

(71) Applicant: LION GROUP, INC., Dayton, OH (US)

(72) Inventors: Kathryn Ann York, Dayton, OH (US); Donald Aldridge, Dayton, OH (US); Josephine McIntosh, Dayton, OH (US); Keshia Jo Gevedon, Dayton, OH (US); Richard H. Harris, Dayton, OH (US); Calvin Clark Brant, Dayton, OH (US)

(73) Assignee: LION GROUP, INC., Dayton, OH (US)

( * ) Notice: Subject to any disclaimer, the term of this patent is extended or adjusted under 35 U.S.C. 154(b) by 185 days.

(21) Appl. No.: 17/747,673

(22) Filed: May 18, 2022

(65) Prior Publication Data

US 2022/0369744 A1 Nov. 24, 2022

Related U.S. Application Data

(60) Provisional application No. 63/190,530, filed on May 19, 2021.

(51) Int. Cl.
*A41D 1/02* (2006.01)
*A41D 27/18* (2006.01)

(52) U.S. Cl.
CPC ..... *A41D 27/18* (2013.01); *A41D 1/02* (2013.01)

(58) Field of Classification Search
CPC ..... A41D 3/00; D41D 1/02; A41B 3/02
See application file for complete search history.

(56) References Cited

U.S. PATENT DOCUMENTS 2,178,777 A * 11/1939 Chapel ..... A41B 3/02 2/127
2,319,292 A 5/1943 Boggs
(Continued)

FOREIGN PATENT DOCUMENTS

CN 1308972 4/2007
DE 3503389 10/1986
(Continued)

OTHER PUBLICATIONS

International Search Report and Written Opinion issued Aug. 17, 2022 which pertains to PCT Application No. PCT/US2022/029821 filed May 18, 2022, 10 pages.
(Continued)

*Primary Examiner* — Jillian K Pierorazio
(74) *Attorney, Agent, or Firm* — Thompson Hine LLP

(57) ABSTRACT

A coat including a coat body and a fixed collar coupled to the coat body and configured to extend generally circumferentially when the coat is worn, the fixed collar having a fixed collar retaining component. The coat further includes a protective collar that is movable between a retracted position wherein at least part of the protective collar is positioned in the fixed collar, and an extended position wherein less of the protective collar is positioned in the fixed collar than when the protective collar is in the retracted position. The protective collar is configured to move in a generally circumferential direction when moving between the extended position and the retracted position. The protective collar has a protective collar retaining component that is configured to interact with the fixed collar retaining component to releasably retain the protective collar in the extended position.

32 Claims, 14 Drawing Sheets

(56) References Cited

U.S. PATENT DOCUMENTS 2,389,298 A 11/1945 Ellis
2,397,931 A 4/1946 Ellis
2,507,322 A * 5/1950 Smith ..... A41D 3/00 D2/831
2,800,660 A * 7/1957 Myrick ..... A41B 3/00 2/116
2,893,012 A * 7/1959 Kahn ..... A41B 3/02 2/116
3,008,209 A 11/1961 Kurt
3,009,225 A 11/1961 Budreck
3,086,268 A 4/1963 Chaffin, Jr.
3,161,932 A * 12/1964 Seymour ..... A41F 1/002 24/303
3,171,176 A 3/1965 Shirley
3,231,899 A * 2/1966 Seidel ..... A41D 3/02 2/93
4,249,267 A 2/1981 Voss
4,399,595 A 8/1983 Yoon et al.
4,475,252 A * 10/1984 Peyser ..... A41F 19/005 2/125
4,825,526 A 5/1989 Shenier et al.
4,879,769 A 11/1989 Grilliot
5,083,319 A 1/1992 Grilliot et al.
5,127,106 A 7/1992 Aldridge
5,153,941 A * 10/1992 Grilliot ..... A41D 13/0002 2/81
5,208,951 A 5/1993 Aoki
5,249,338 A 10/1993 Aoki
5,253,394 A 10/1993 Morita
5,274,850 A 1/1994 Aldridge
5,274,853 A * 1/1994 Millican ..... A41B 3/02 2/129
5,450,658 A 9/1995 Hicks
5,604,960 A 2/1997 Good
5,682,653 A 11/1997 Berglof et al.
5,692,240 A * 12/1997 Steele ..... A41B 3/02 2/128
5,983,464 A 11/1999 Bauer
5,991,924 A * 11/1999 Grilliot ..... A62B 17/001 2/81
6,038,700 A 3/2000 Aldridge et al.
6,163,889 A 12/2000 Tate
6,370,692 B1 4/2002 Van Duyn
6,378,174 B1 4/2002 Wong
6,434,801 B2 8/2002 Grunberger
6,687,913 B2 2/2004 Aldridge
6,829,847 B2 12/2004 O'Shea et al.
6,934,970 B1 * 8/2005 Watkins ..... A41D 13/0512 2/96
6,972,654 B1 12/2005 Brock
7,039,958 B2 * 5/2006 Henricksen ..... A42B 1/22 2/311
7,065,841 B2 6/2006 Sjoquist
7,178,207 B2 2/2007 Wong et al.
7,187,261 B2 3/2007 Cassar
7,597,126 B2 10/2009 Chen
D627,950 S * 11/2010 Carpentier ..... D2/750
RE44,271 E 6/2013 Keeter
8,662,682 B2 3/2014 Gorodisher et al.
9,210,953 B2 12/2015 Horton
9,301,564 B2 4/2016 Roeckelein
9,364,040 B2 6/2016 Saladino
9,521,873 B1 12/2016 Mignone
9,549,580 B2 1/2017 Horton
9,572,386 B1 2/2017 Scheer et al.
10,478,644 B2 11/2019 Leggett et al.
2002/0178551 A1 12/2002 Hsu
2004/0158910 A1 * 8/2004 Bay ..... A41D 13/0581 2/69
2004/0181845 A1 * 9/2004 Droppo ..... A41B 3/02 2/141.2
2004/0226195 A1 11/2004 Martinez
2006/0048267 A1 * 3/2006 Keeter ..... A41D 27/18 2/141.2
2006/0048293 A1 * 3/2006 Lewis ..... A41D 27/18 2/468
2007/0266476 A1 * 11/2007 Ulrich ..... A42B 7/00 2/202
2008/0104742 A1 5/2008 Alperin et al.
2008/0163404 A1 * 7/2008 Carpentier ..... A41D 13/0512 2/81
2008/0282443 A1 * 11/2008 Curtis ..... A41D 27/10 2/243.1
2009/0178245 A1 7/2009 Albert
2009/0283197 A1 11/2009 Gorodisher
2009/0320176 A1 * 12/2009 Curtis ..... A41D 31/085 2/87
2009/0320181 A1 12/2009 Macgregor, Jr.
2010/0269239 A1 10/2010 Kulp et al.
2012/0079688 A1 5/2012 Bunting
2012/0233748 A1 9/2012 Curtis
2013/0117902 A1 * 5/2013 Aresty ..... A41B 3/02 2/69
2014/0041093 A1 * 2/2014 Korobkin ..... A41D 27/16 2/60
2014/0109303 A1 4/2014 Curtis
2014/0130231 A1 5/2014 Horton
2014/0259266 A1 9/2014 Federlin
2015/0047105 A1 * 2/2015 Fonzo ..... A41F 1/002 2/265
2017/0196280 A1 7/2017 Murphy
2018/0116305 A1 * 5/2018 Cheuk ..... B63C 11/04
2019/0110527 A1 4/2019 Ghasletwala
2019/0110538 A1 4/2019 Ghasletwala
2019/0116894 A1 4/2019 Brannon
2019/0261710 A1 8/2019 Branan
2020/0229516 A1 7/2020 Curran
2020/0268060 A1 8/2020 Siragusa

FOREIGN PATENT DOCUMENTS

DE 2020 05020354 U1 4/2006
EP 0 691 017 7/1998
EP 1 264 553 12/2002
EP 1 529 459 5/2005
GB 854589 11/1960
GB 2 282 955 4/1995
JP 2005-028022 2/2005
KR 10-1914508 10/2018
WO 2006/002592 1/2006
WO 2016/160648 10/2016
WO 2019/111595 6/2019
WO 2019/162740 A1 8/2019

OTHER PUBLICATIONS

Koga et al., Machine Translation—JP 2005-28022 A, pp. 1-9.
City of Bolivar; "Specifications and Documents for Fire Fighting Turnout Gear for City of Bolivar"; 18 pages (Sep. 2014).
Condor Golf, LLC; "EZ Loader Magnetic Headcover" product information; 6 pages (at least as early as Jun. 2020).
Titleist—Titleist 909D Driver Headcover Magnetic 909-D Golf Club Cover product description; 1 page (at least as early as Jun. 2020).
You Sew Girl !; "How to make sew-in-magnets"; available at https://nicolemdesign.blogspot.com/2008/12/how-to-make-sew-in-magnets.html; 8 pages (Dec. 8, 2008).
Documentation relating to a firefighter garment shown to a potential customer; 6 pages (May 2019).
Neodymium Magnet with Red Dot to Indicate North Pole, accessed from Amazon https://www.amazon.com/Neodymium-Strongest-Powerful-Magnets-Applied/dp/B01MSTKTSF, 2016. 4 pages.
Hand2Mind Ceramic Bar Magnet, accessed from Amazon https://www.amazon.com/hand2mind-1-5-Inch-Ceramic-Magnets-Classroom/dp/B01MT1PF1P, 2016. 1 page.

* cited by examiner

PROTECTIVE COAT WITH RETRACTABLE COLLAR

This application claims priority to U.S. Provisional Patent Application Ser. No. 63/190,530, filed on May 19, 2021, the entire contents of which are hereby incorporated by reference.

This application relates to a protective garment, and more particularly, to a protective garment with a collar that can be retracted.

BACKGROUND

Protective or hazardous duty garments are used in a variety of industries and settings to protect the wearer from hazardous conditions such as heat, smoke, cold, sharp objects, chemicals, liquids, fumes and the like. The protective garments often include a fixed collar to provide further protection to the wearer.

SUMMARY

In one embodiment the invention is a coat including a coat body and a fixed collar coupled to the coat body and configured to extend generally circumferentially when the coat is worn, the fixed collar having a fixed collar retaining component. The coat further includes a protective collar that is movable between a retracted position wherein at least part of the protective collar is positioned in the fixed collar, and an extended position wherein less of the protective collar is positioned in the fixed collar than when the protective collar is in the retracted position. The protective collar is configured to move in a generally circumferential direction when moving between the extended position and the retracted position. The protective collar has a protective collar retaining component that is configured to interact with the fixed collar retaining component to releasably retain the protective collar in the extended position.

DETAILED DESCRIPTION

Figure 1:
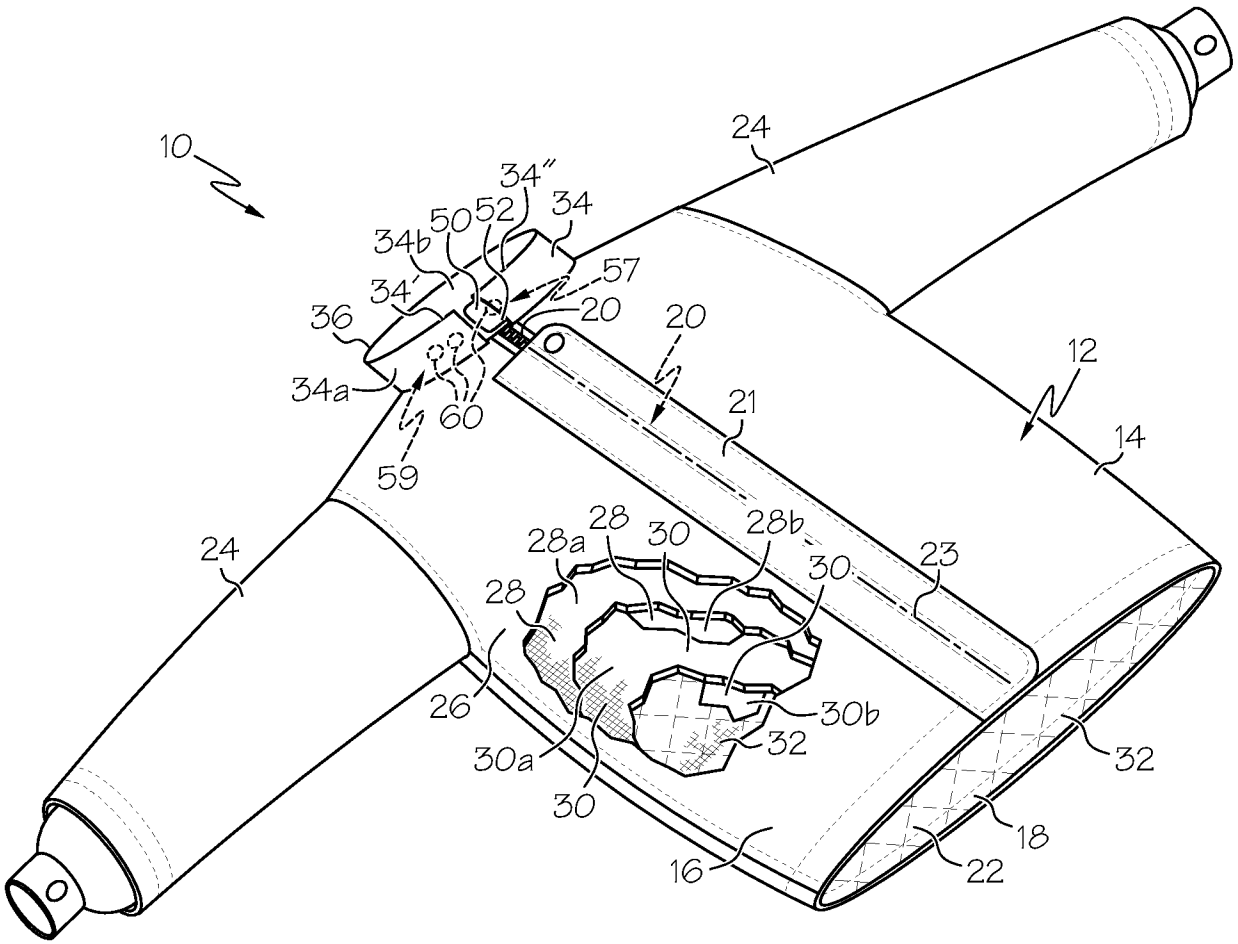
FIG. 1 is a front perspective view of a coat, with portions of various layers cut away, and with a protective collar in a retracted position.
Figure 2:
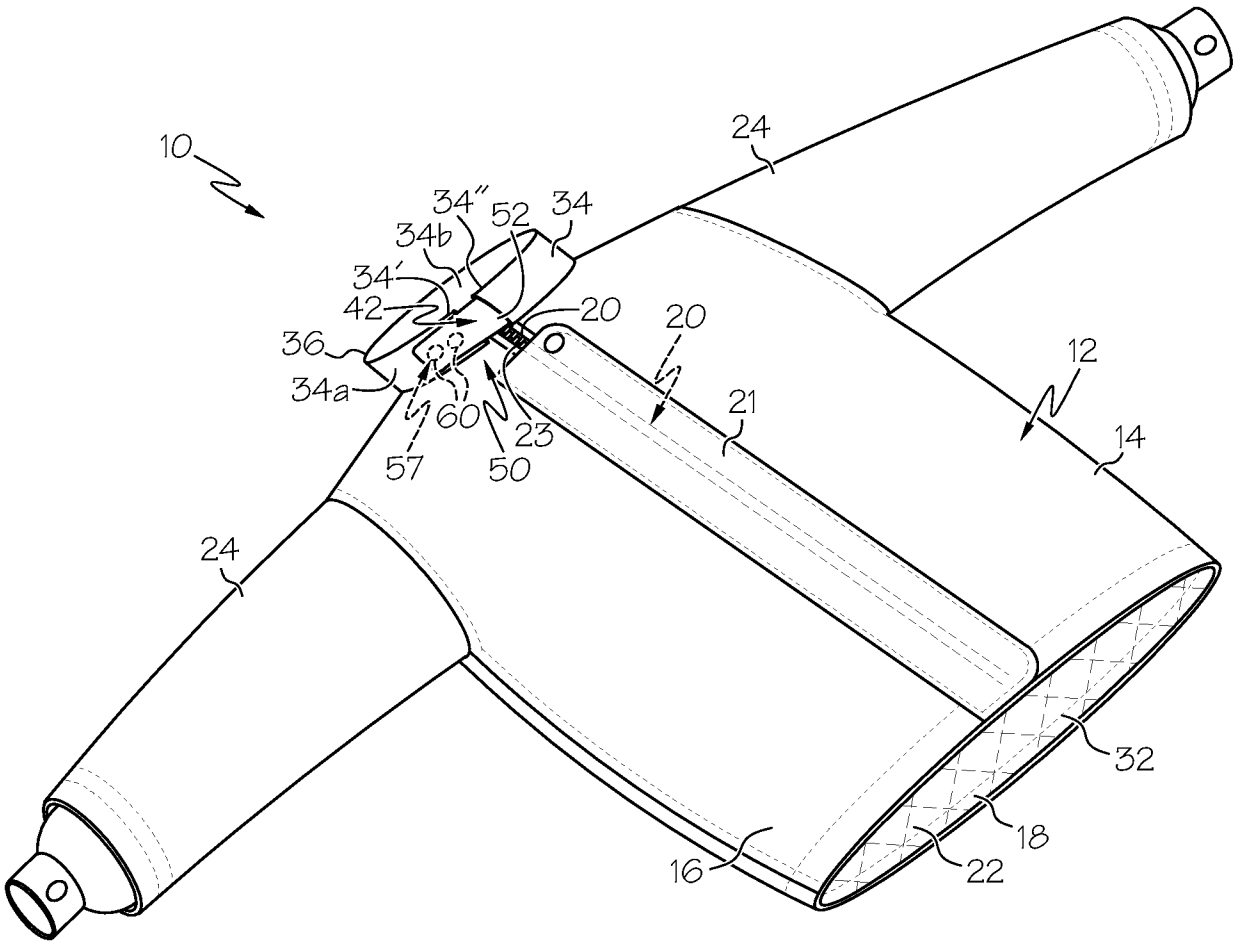
FIG. 2 is a front perspective view of the coat of FIG. 1, with the protective collar in an extended position.

FIG. 1 illustrates a protective or hazardous duty garment in the form of a firefighter's garment or coat, generally designated 10. The coat 10 may include a body or body portion 12 having a left front panel 14, right front panel 16 and a back panel 18. The left front panel 14 and right front panel 16 may be releasably attachable by a fastener 20, such as a zipper, snaps, clasps, clips, hook-and-loop fastening material (e.g., VELCRO® fastening material), magnets, combinations of these components or the like. The coat fastener 20 may extend generally linearly, and the coat 10 may have a center line 23. The fastener 20 may be aligned with the center line 23 and/or may define the center line 23, or in some cases the fastener 20 may be offset from the center line 23. The center line 23 can be configured to be aligned with the front center (e.g. a midsagittal or median plane) of a wearer 45 and/or define the center of the coat 10 when the coat 10 is laid flat as shown in FIG. 1. Part or all of the fastener 20 can be covered by a storm flap 21 (FIGS. 1, 2 and 11) when the storm flap 21 is in its closed position. The body portion 12 may define a torso cavity 22 that is shaped and configured to receive a wearer's torso therein. The coat 10 may include a pair of sleeves 24 coupled to and extending generally outwardly from the body portion 12 and shaped to receive a wearer's arms therein, and a collar 34.

The coat 10 may include various layers through its thickness to provide various heat, moisture and/or abrasion resistant qualities to the coat 10 so that the coat 10 can be used as a protective, hazardous duty, and/or firefighter garment. For example, with reference to FIG. 1 the coat 10 may include an outer shell, outer layer or outer material 26, a moisture barrier 28 located inside of and adjacent to the outer shell 26 (e.g. positioned between the outer shell 26 and the torso cavity 22), a thermal liner or barrier 30 located inside of and adjacent to the moisture barrier 28, and an inner liner or face cloth 32 (such as chambray fabric) located inside of and adjacent to the thermal barrier 30.

The outer shell 26 may be made of or include a variety of materials, including a flame, heat and abrasion resistant material such as a compact weave of aramid fibers and/or polybenzamidazole fibers. Commercially available aramid materials include NOMEX and KEVLAR fibers (both trademarks of E.I. DuPont de Nemours & Co., Inc. of Wilmington, Delaware), and commercially available polybenzamidazole fibers include PBI fibers (a trademark of PBI Performance Fabrics of Charlotte, North Carolina). Thus, the outer shell 26 may be an aramid material, a blend of aramid materials, a polybenzamidazole material, a blend of polybenzamidazole fibers, a blend of aramid and polybenzamidazole materials, a poly-phenylene benzobisoxazole (PBO) material, a thermostable organic polymer material, such as KERMEL® material sold by Kermel SAS of Colmar, France, a blend of any of the materials listed above, or other appropriate materials.

If desired, the outer shell 26 may be coated with a polymer, such as a durable, water repellent finish or coating (i.e. a perfluorohydrocarbon finish, such as TEFLON® finish sold by E. I. Du Pont de Nemours and Company of Wilmington, Delaware, or a fluorine free water repellent finish). The materials of the outer shell 26 may have a weight of, for example, between about five and about ten oz./yd$^2$. Moreover, if desired the outer shell 26 may have a self-decontaminating finish or coating applied thereto.

The moisture barrier 28 and thermal barrier 30 may be generally coextensive with the outer shell 26, or spaced slightly inwardly from the outer edges of the outer shell 26 (i.e., spaced slightly inwardly from the outer ends of the sleeves 24, the collar 34 and/or from the lower edge or hem of the coat 10) to provide moisture and thermal protection throughout the coat 10. The moisture barrier 28 may include a semi-permeable membrane layer 28*a* and a substrate 28*b*.

The membrane layer 28*a* may be generally water vapor permeable but generally impermeable to liquid moisture. The membrane layer 28*a* may be made of or include expanded polytetrafluoroethylene ("PTFE") such as GORE-TEX or CROSSTECH materials (both of which are trademarks of W.L. Gore & Associates, Inc. of Newark, Delaware), STEDAIR particulate barrier material sold by Stedfast, Inc. located in Quebec Canada, polyurethane-based materials, neoprene-based materials, cross-linked polymers, polyaramid, or other materials. The membrane layer 28*a* may have microscopic openings that permit moisture vapor (such as water vapor) to pass therethrough, but block liquids (such as liquid water) from passing therethrough. The membrane layer 28*a* may be made of a microporous material that is either hydrophilic, hydrophobic, or somewhere in between. The membrane layer 28*a* may also be monolithic and may allow moisture vapor transmission therethrough by molecular diffusion. The membrane layer 28*a* may also be a combination of microporous and monolithic materials (known as a bicomponent moisture barrier), in which the microporous or monolithic materials are layered or intertwined.

The membrane layer 28*a* may be bonded, adhered or otherwise coupled to the substrate 28*b* of a flame and heat resistant material to provide structure and protection to the membrane layer 28*a*. Thus, either the membrane layer 28*a* alone, or the membrane layer 28*a* in combination with the moisture barrier substrate 28*b*, may be considered to constitute the moisture barrier 28. The substrate 28*b* may be or include aramid fibers similar to the aramid fibers of the outer shell 26, but may be thinner and lighter in weight. The substrate 28*b* may be woven, non-woven, spunlace or other materials. In the illustrated embodiment, the membrane layer 28*a* is located between the outer shell 26 and the substrate 28*b*. However, the orientation of the moisture barrier 28 may be reversed such that the substrate 28*b* is located between the outer shell 26 and the membrane layer 28*a*.

The thermal barrier 30 may be made of nearly any suitable flame resistant material that provides sufficient thermal insulation. In one embodiment, the thermal barrier 30 may include a layer of bulk material 30*a* in the form of relatively thick (i.e. between about 1/16"-3/16") batting, felt or needled non-woven bulk or batting material. The bulk material 30*a* can include aramid fiber batting (such as NOMEX batting), aramid needlepunch material, an aramid non-woven material, an aramid blend needlepunch material, an aramid blend batting material, an aramid blend non-woven material, foam (either open cell or closed cell), or other suitably thermally insulating materials. The bulk material 30*a* may trap air and possess sufficient loft to provide thermal resistance to the coat 10.

The bulk material 30*a* may be quilted or otherwise coupled to a thermal barrier face cloth 30*b* which can be a weave of a lightweight aramid material. Thus, either the bulk material 30*a* alone, or the bulk material 30*a* in combination with the thermal barrier face cloth 30*b*, may be considered to constitute the thermal barrier 30. In the illustrated embodiment, the thermal barrier bulk material 30*a* is located between the outer shell 26 and the thermal barrier face cloth 30*b*. However, the orientation of the thermal barrier 30 may be reversed such that the thermal barrier face cloth 30*b* is located between the outer shell 26 and the bulk layer 30*a*. If desired, the thermal barrier 30 may be treated with a water-resistant or water-repellent finish. In one embodiment, the thermal barrier 30 (and/or the coat 10 as a whole) may have a thermal protection performance ("TPP"), as specified in the 1986 revision of the National Fire Protection Association ("NFPA") 1971, Protective Clothing for Structural Fire Fighting Standards, of at least about twenty, and the coat 10 as a whole may have a TPP of at least about thirty-five, although the TPP values can vary.

Although the moisture barrier 28 is shown as being located between the outer shell 26 and the thermal barrier 30, the positions of the moisture barrier 28 and thermal barrier 30 may be reversed such that the thermal barrier 30 is located between the outer shell 26 and the moisture barrier 28, or additional moisture barrier 28 and/or thermal barrier layers 30 can be utilized or various other orientations or configurations may be used.

The face cloth 32 may be the innermost layer of the coat 10, located inside the thermal barrier 30 and moisture barrier 28. The face cloth 32 can provide a comfortable surface for the wearer 45 and protect the thermal barrier 30 and/or moisture barrier 28 from abrasion and wear. The face cloth 32 may be quilted to the adjacent layer (i.e. the thermal barrier 30 in the illustrated embodiment). However, the face cloth 32 is optional and may be excluded if desired. In addition, the coat 10 may not necessarily include the moisture barrier 28 and/or the thermal barrier 30 in certain cases.

Each layer of the coat 10 disclosed herein, including the layers and components described above (including the fixed collar 34 and protective collar 50, 50'), as well as those described below, and the coat 10 as a whole, may meet the National Fire Protection Association ("NFPA") 1971 standards for protective firefighting garments ("Protective Clothing for Structural Firefighting"), which standards as of the filing date of this application are entirely incorporated by reference herein. The NFPA standards specify various minimum requirements for heat and flame resistance and tear strength. For example, in order to meet the NFPA standards, the outer shell 26, moisture barrier 28, thermal barrier 30 and face cloth 32 must be able to resist igniting, burning, melting, dripping, separation, and/or shrinking more than 10% in any direction after being exposed to a temperature of 500° F. for at least five minutes. Furthermore, in order to meet the NFPA standards, the combined layers of the coat 10 must provide a TPP rating of at least thirty-five.

Alternately or in addition to the NFPA Standard 1971, the coat 10 and other components disclosed herein (including the fixed collar 34 and/or protective collar 50, 50') may meet standards of other countries or regions, including the European Norm ("EN") standards for firefighting garments set by the European Committee for Standardization (also known as Comité Européen de Normalisation ("CEN")). These standards include EN 469:2005 Level 1 and Level 2 certification. The EN standards for firefighter and protective garments in place as of the filing date of this application are entirely incorporated by reference herein.

The coat 10 may include the collar 34, which can also be termed a fixed collar, permanent collar, an outer collar, or simply the collar 34. The fixed collar 34 can be positioned at an upper end of the coat 10 and extend generally circumferentially when the coat 10 is worn and/or in the closed/zipped/fastened configuration. The fixed collar 34 can be permanently, fixedly and non-movably coupled to the body portion 12, and in one case is not extendable or translatable relative to the body portion 12.

The fixed collar 34 can in one case extend about 360° when the coat 10 is in the closed configuration, and in other cases can extend less than 360° (e.g. at least about 330° in one case, or at least about 340° in another case, or at least about 350° in yet another case) thereby defining a gap or discontinuity 44, in one case aligned with or overlapping with the center line 23 of the coat 10. In some cases the fixed collar 34 extends 360 degrees or more, in which case there may be an overlap and thus no gap, but there may be a discontinuity 44, and gap 44 may be introduced where the collar 34 separates during donning or doffing. Thus the collar 34 can be generally "U" shaped or "O" shaped in top view in one embodiment, and had two opposite end portions 34', 34" on opposite sides of the gap (when present) or discontinuity 44. One end portion 34' can be positioned on a first side of the center line 23/gap 44 and the other end portion 34" can be positioned on a second, opposite side of the center line 23/gap 44. The coat 10 can in one case include only a single fixed collar 34.

Figure 9:
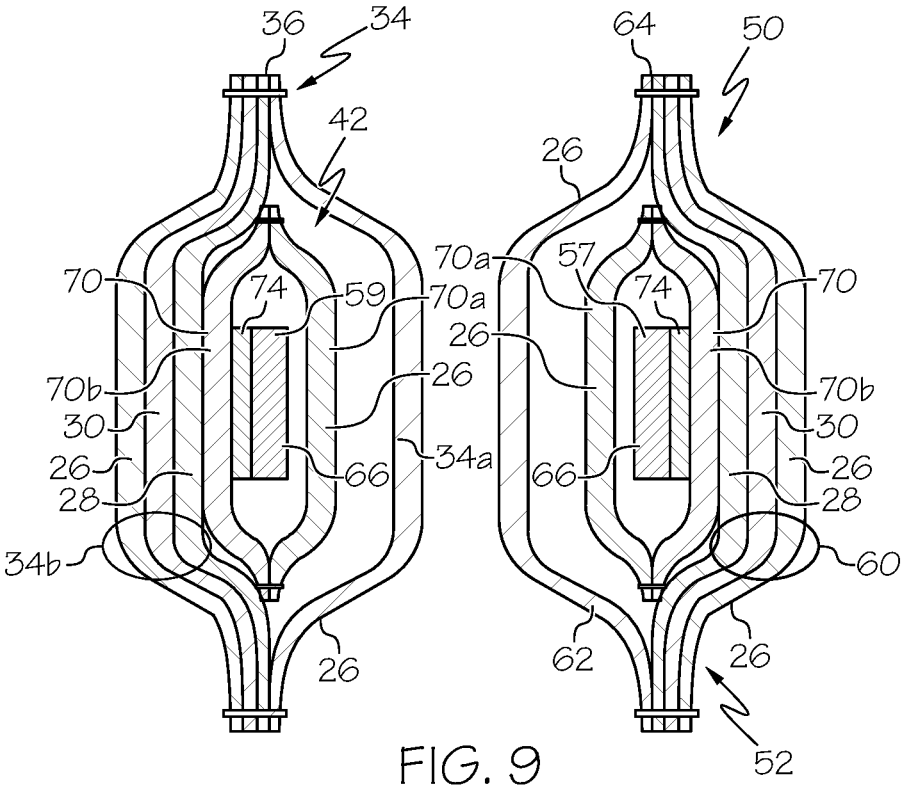
FIG. 9 is a side cross-section taken along line 9-9 of FIG. 4.

In one embodiment, the fixed collar 34 is a two-ply component, including outer ply 34*a* and inner ply 34*b* connected to each other along a seam 36 as shown, for example, in FIG. 9 as an upper seam 36 in the illustrated embodiment. However the plies 34*a*, 34*b* could be also or instead by coupled by a lower seam. The plies 34*a*, 34*b* can, in one case, be entirely separate pieces of material joined along the seam 36, or in another case both plies 34*a*, 34*b* are formed from a single piece of material, folded about itself along a longitudinal or circumferential fold or crease line in place of the seam 36.

Figure 8:
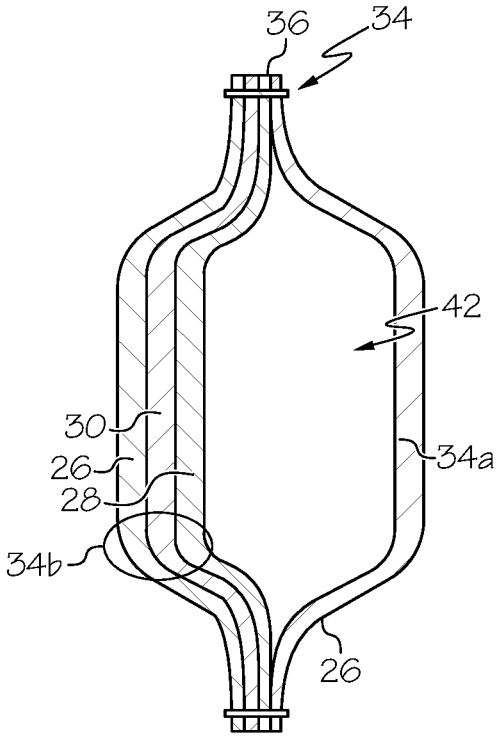
FIG. 8 is a side cross-section taken along line 8-8 of FIG. 4.

Each ply 34*a*, 34*b* can be made of various materials and various combinations of materials, but in one embodiment, as shown in FIG. 8, the outer ply 34*a* includes or is made of layers of outer shell 26, and the inner ply 34*b* is includes or is made of layers of the outer shell, 26, thermal barrier 30 and moisture barrier 28 as described above. In this manner, in the illustrated embodiment the inner ply 34*b* of the fixed collar 34 can be made of the same materials and have generally the same construction as outlined above for the body portion 12 of the coat 10 (but lacking the face cloth 32 in some cases). Thus as can be seen in the embodiment of FIG. 8 the inner ply 34*b* of the collar 34 provides a high level of protection to the wearer 45, whereas the outer ply 34*a* may include less protective components (e.g. may lack the thermal barrier 30 and/or moisture barrier 28) since that protection is provided by the inner ply 34*b*. However the outer 34*a* and inner 34*b* plies can include various different layers that can differ from those explicitly shown herein. For example the outer ply 34*a* includes the thermal barrier 30 and/or moisture barrier 28, and/or the inner ply 34*b* may lack the thermal barrier 30 and/or moisture barrier 28.

The plies 34*a*, 34*b* of the fixed collar 34 thereby define a cavity 42 therebetween and positioned within the fixed collar 34, extending generally circumferentially. If desired, the outer ply 34*a* may be simply folded downwardly and remain in place by the folded nature of the collar 34. Alternatively, the outer ply 34*a* can be secured in place to the body portion 12 and/or inner ply 34*b* by stitching at a bottom end thereof, or various other fastenings devices or mechanisms such as a zipper, hook and loop fastening material (such as VELCRO®) or the like.

The coat 10 can include a protective collar, movable collar or protective collar component 50 which, in the illustrated embodiment, include or takes the form of a tab 52. The protective collar 50/tab 52 is positionable in a first or retracted or disengaged position (e.g. when the coat 10 is worn and/or the fastener 20 of the coat 10 is fully fastened), as shown in FIG. 1. When the protective collar 50/tab 52 is in the retracted position, the protective collar 50/tab 52 is generally and/or at least partially positioned in the cavity 42 or fixed collar 34 ("positioned in," in this context, can mean for example positioned radially inside at least part of the fixed collar 34 (e.g. positioned radially inside the outer ply 34*a*) and/or positioned in the cavity 42 between the two plies 34*a*, 34*b*).

When in the retracted position, the protective collar 50/tab 52 can be coupled to and/or positioned in and/or positioned adjacent and/or positioned in an overlapping relationship in the radial direction relative to the first portion 34' of the fixed collar 34, and not the second portion 34" of the fixed collar 34. In addition, when in the retracted position the protective collar 50/tab 52 can be entirely positioned on a first side of the center line 23 and/or the gap 44. Moreover, when in the retracted position, at least about 50% of the length of the protective collar 50/tab 52 (e.g. in the circumferential direction) and/or at least about 50% the surface area of the protective collar 50/tab 52 is received in the fixed collar 34/cavity 42, and in other embodiments at least about 70%, or at least about 80%, or at least about 90%, and in another case, the entirety of the length and/or surface area of the protective collar 50/tab 52 is positioned in the fixed collar 34/cavity 42 when the protective collar 50/tab 52 is in the retracted position.

The protective collar 50/tab 52 is movable to a second, extended or engaged position or positions (e.g. when the coat 10 is worn and/or when the fastener 20 of the coat 10 is fully fastened), as shown in FIGS. 2 and 4-7. In the extended position(s), less of the protective collar 50/tab 52 is received in the fixed collar 34/cavity 42 than when the protective collar 50/tab 52 is in the retracted position. When in the extended position the protective collar 50/tab 52 can extend across and/or span the gap 44 and/or center line 23 and be positioned immediately adjacent to the second portion 34" (e.g. overlap in the radial direction) of the fixed collar 34.

In one case the protective collar 50/tab 52 entirely extend across and/or cover the gap 44, if a gap 44 is present, and at least part of the protective collar 50/tab 52 is positioned on second, opposite side of the center line 23. Moreover, when in the extended position, at least about 30% of the length of the protective collar 50/tab 52 (e.g. in the circumferential direction) and/or at least about 30% of the surface area is not received in the fixed collar 34/cavity 42, and in other embodiments at least about 40%, or at least about 50%, or at least about 70%, or at least about 90% of the length and/or surface area of the protective collar 50/tab 52 is not positioned in the fixed collar 34/cavity 42 when the protective collar 50/tab 52 is in the extended position.

When in the extended position the protective collar 50/tab 52 can extend across the throat/neck portion of a wearer 45, and be positioned entirely below the nose, eyes, ears and/or chin of a wearer 45. The protective collar 50/tab 52 is configured to move in a translation motion, in a generally circumferential direction, when moving between the retracted and extended positions. Thus in one case the protective collar 50/tab 52 is not deformed or folded upon itself when in the retracted position as compared to the extended position (or vice versa), and has the same shape/configuration in both positions.

The protective collar 50/tab 52 can be biased to the retracted position by a biasing mechanism 51. In one case the biasing mechanism includes or take the form of an elastic component 54 that is coupled to the protective collar 50/tab 52 and the fixed collar 34. The elastic component 54 may be relaxed or unstretched (or relatively relaxed or unstretched) when the protective collar 50/tab 52 is in the retracted position, and stretched/placed in tension (or more stretched/placed under more tension) when the protective collar 50/tab 52 is in the extended position. The elastic component 54 can be made of a resilient material which can deform or elongate when a force is applied thereto (particularly along its longitudinal direction), and when so deformed is biased to return to its original shape/position. When the force is removed the elastic component 54 returns to its original, undeformed shape.

In this manner, when the protective collar 50/tab 52 is in the extended position, the biasing mechanism 51/elastic component 54 applies a biasing force to return the protective collar 50/tab 52 to the retracted position. As will be described in greater detail below, the protective collar 50/tab 52 and/or collar 34 can include retaining components 57, 59 that cooperate to retain the protective collar 50/tab 52 in the extended position (using cooperating magnets 66 and/or magnetizable components in one particular embodiment). Thus when the retaining components 57, 59 are released, the protective collar 50/tab 52 may automatically return to its retracted position as shown in FIG. 1. As will also be described in further detail below the biasing mechanism 51 can take various other forms besides the elastic component 54.

When in the extended position, the protective collar 50/tab 52 can provide increased protection to the wearer 45. In particular, the protective collar 50/tab 52 can span the gap 44 which may be present in the coat 10, particularly when the wearer 45 is in a position which tends to pull the panels 14, 16 apart. Thus a gap 44 may not necessarily be present during normal wearing or usage of the coat 10, but can be introduced when the wearer 45 is in a physically stressed situation or external forces are applied to the coat 10. Even if a gap 44 is not present the protective collar 50/tab 52 can provide additional protection to the throat/neck of the wearer 45, which can be a vulnerable body part of the wearer 45.

When in the extended position, at least part of the protective collar 50/tab 52 may remain in the cavity 42/collar portion 34' to provide more complete protection to the wearer 45. In addition, the protective collar 50/tab 52 may have a vertical height, or dimension extending along a height of the coat 10, that is within about 75% in one case, or about 90% in another case, of the height of the fixed collar 34 and/or the height of the fixed collar 34 at the portions 34', 34", such that the protective collar 50/tab 52 can thereby provide the same or similar protection to a wearer 45 as the fixed collar 34 when the protective collar 50/tab 52 is in the extended position.

Figure 3:
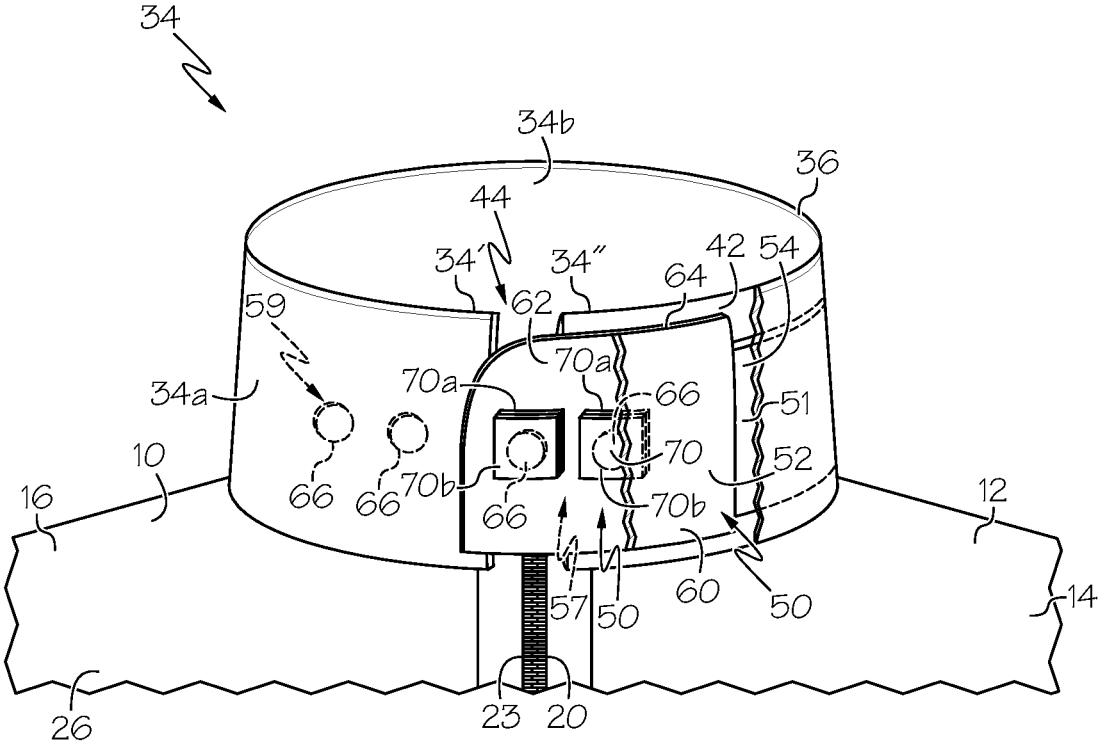
FIG. 3 is a detail perspective of the collar area of the coat of FIG. 1, with the protective collar in a partially extended position with portions of the fixed collar and the protective collar cut away.
Figure 4:
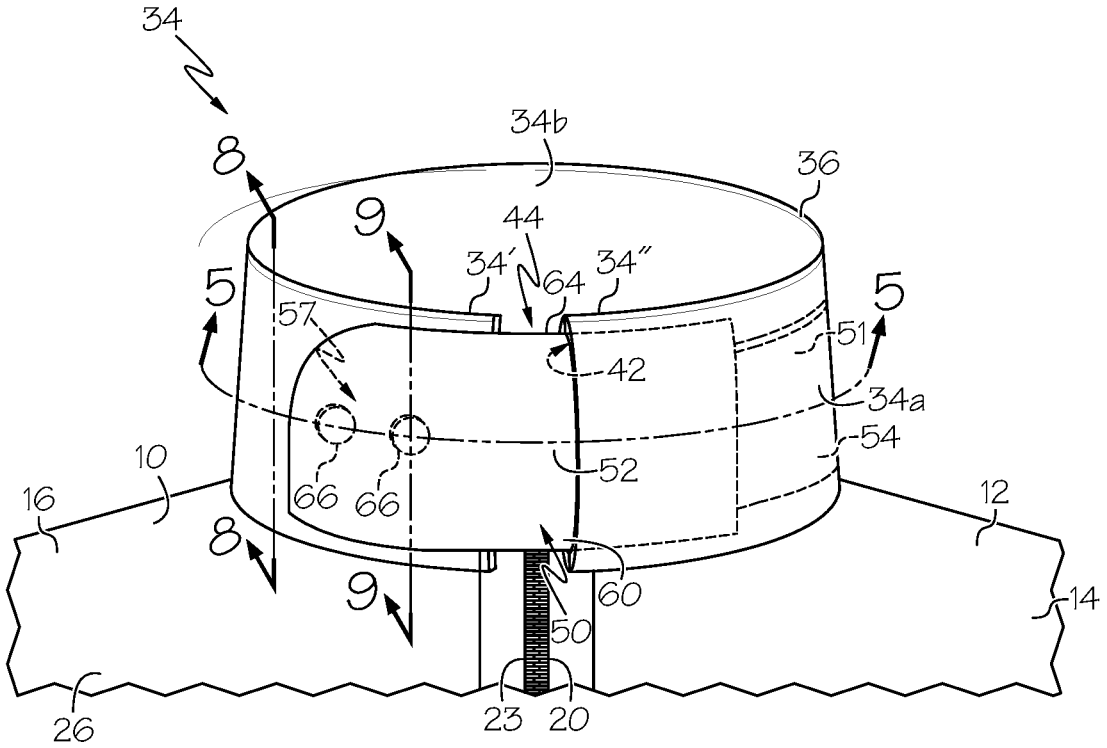
FIG. 4 is a detail perspective of the collar area of the coat of FIG. 2.

With reference to FIGS. 3 and 9, in one embodiment, the tab 52 is a two-ply component, including outer ply 60 and inner ply 62. The plies 60, 62 can, in one case, be entirely separate and joined along a seam 64 that is shown as an upper seam 64 in the illustrated embodiment, but could instead be a lower seam. In another case both plies 60, 62 are formed from a single piece of material, folded about itself along a longitudinal fold or crease line in place of the seam 64. In one case, each ply 60, 62 can be made of the same material or layers as the various plies 34*a*, 34*b* of the collar 34 and include, as desired, an outer shell 26, a thermal barrier 30, moisture barrier 28 and/or face cloth 32, etc.

The protective collar 50/tab 52 can have a protective collar retaining component 57 that is, in one case, directly, and not movably, coupled to the protective collar 50/tab 52, and the fixed collar 34 can have a fixed collar retaining component 59 directly, and not movably, coupled to the fixed collar 34. The retaining components 57, 59 can be configured to interact to retain the protective collar 50/tab 52 in the extended position. In one case at least one of the retaining components 57, 59 includes or take the form of one or more magnets 66, and the other of the retaining components 57, 59 includes or take the form of one or more magnet(s) 66 or magnetizable material, such as a ferrous metal. The protective collar retaining component 57 and fixed collar retaining component 59 can be positioned on opposite sides of the gap/discontinuity 44 and/or center line 23 when the collar 50/tab 52 is in the retracted position, and be positioned on the same side when the collar 50/tab 52 is in the extended position.

In the manner, when the retaining components 57, 59 are positioned sufficiently close they magnetically interact, as shown in FIGS. 2 and 4-7, when the protective collar 50/tab 52 is in the extended position to overcome the return force applied by the biasing mechanism 51, to retain the protective collar 50/tab 52 in the extended position. In this manner when the protective collar 50/tab 52 is in the extended position the protective collar 50/tab 52 is removably attachable to an outermost surface of the fixed collar 34 by cooperation between the retaining components 57, 59.

When the protective collar retaining component 57 and fixed collar retaining component 59 are both magnets 66, they can be arranged such that when the protective collar 50/tab 52 is in its extended position, inwardly-facing face of the magnet(s) 66 of the protective collar retaining component 57 has an opposite pole orientation to the outwardly-facing face of the magnet(s) 66 of the fixed collar retaining component 59. Thus, when the protective collar 50/tab 52 is moved to its extended positions, the magnets 66 magnetically interact and couple with a force greater than that imparted by the biasing mechanism 51, thereby retaining the protective collar 50/tab 52 in its extended position. If one of the protective collar retaining components 57 or fixed collar retaining components 59 has a magnetizable component instead of a magnet 66, the magnet 66 can be arranged in any desired configuration or orientation.

In the illustrated embodiment, the protective collar retaining component 57 includes or takes the form of two magnets

Figure 5:
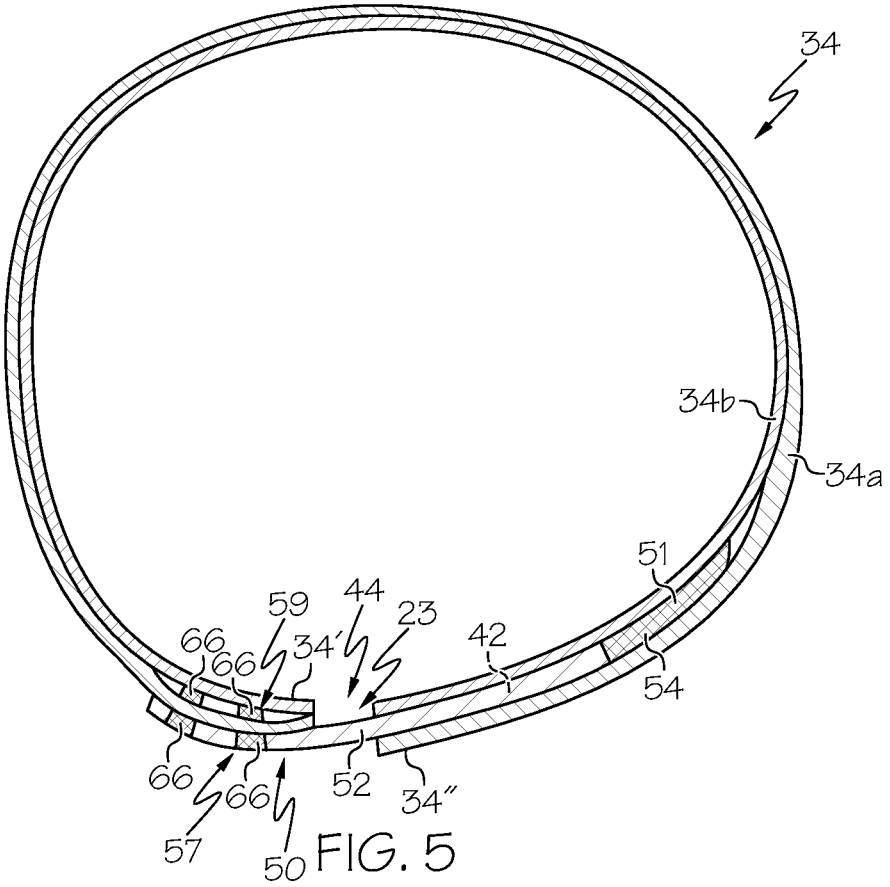
FIG. 5 is a cross-section of the collar taken along line 5-5 of FIG. 4.

66 that are spaced apart in the circumferential direction, and the fixed collar retaining component 59 includes or takes the form of two magnets 66 that are also spaced apart in the circumferential direction by a same distance as the magnets 66 of the protective collar retaining component 57. In this manner, when the protective collar 50/tab 52 is in the extended position both sets of magnets 66 can be aligned and magnetically interact to retain the protective collar 50/tab 52 in the extended position, as shown in FIG. 5.

Figure 6:
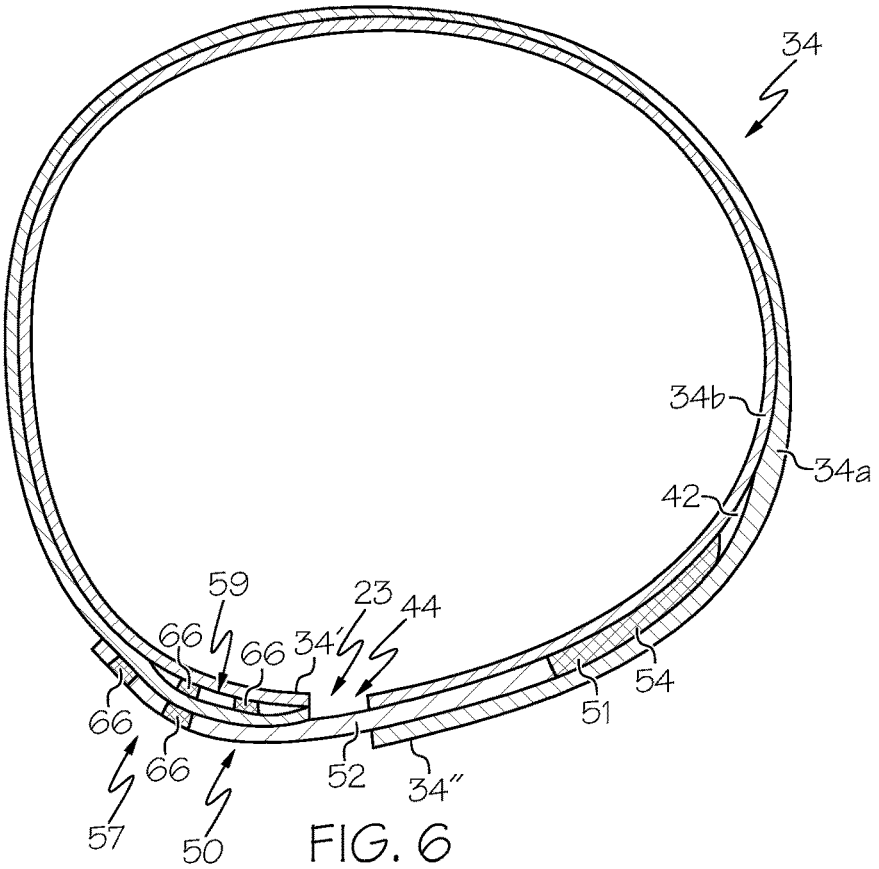
FIG. 6 shows the cross-section of FIG. 5, with the protective collar in an alternate position.
Figure 7:
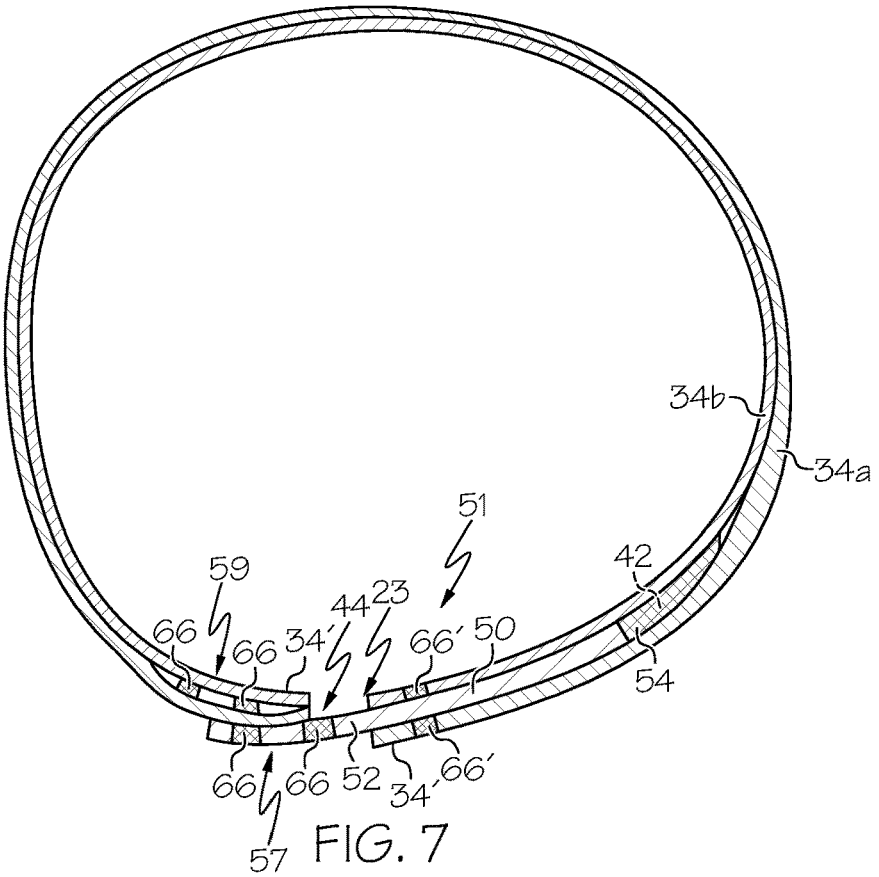
FIG. 7 shows the cross-section of FIG. 5, with the protective collar in another alternate position.

Moreover the use of two (or more) magnets 66 can provide flexibility in the use of the retaining components 57, 59. In particular, if desired only one magnet 66/magnetizable component of each retaining component 57, 59 can be aligned and magnetically secured to each other, to enable the protective collar 50/tab 52 to be retained in an alternate, or first supplemental, extended position as shown in FIG. 6. In this configuration, a tighter fit around the user's neck is provided. Alternatively, the other magnets 66/magnetizable components of the retaining components 57, 59 can be aligned and secured to each other, to enable the protective collar 50/tab 52 to be retained in another alternate, or second supplemental, extended position as shown in FIG. 7. In this configuration, a looser fit around the user's neck is provided. It should be understood that while the illustrated embodiment shows each retaining component 57, 59 as including two magnets, each retaining component 57, 59 may include only single magnet 66/magnetizable component, or more than two magnets 66/magnetizable components can be utilized.

As shown in FIG. 9, the outer ply 60 of the protective collar 50/tab 52 can include more protective layers than the inner ply 62 of the protective collar 50. For example, the outer ply 60 of the protective collar 50/tab 52 can include layers of outer shell 26, thermal barrier 30 and moisture barrier 28 material (each optional as desired), and the inner ply 62 of the protective collar 50/tab 52 can include only outer shell material 26. This combination of layers provides sufficient protection to the wearer 45, and can provide protection at least equal to that provided by the fixed collar 34. However by positioning the protective layers of the protective collar 50/tab 52 in this configuration, there are less layers, and thereby less thickness/distance/interference, between the cooperating magnets 66 (or magnet 66 and magnetizable component) positioned in protective collar 50/tab 52 to ensure the magnets 66 (or magnetizable component) properly magnetically engage with magnets 66 (or magnetizable components) of the fixed collar retaining component 59. The same advantage is provided by having less protective layers on the outer ply 34*a* of the fixed collar 34, as compared to the inner ply 34*b*, as shown in FIG. 9. In this manner there are less layers and/or thickness between the inner (facing) side or surfaces of the magnets 66/magnetizable components than on the outer sides or surfaces. Nevertheless it should be understood that each ply 60, 62 of the protective collar 50/tab 52 can have various layers and construction as desired.

With continued reference to FIG. 9 and also shown in FIG. 3, in one embodiment each of the magnets 66 or magnetizable components is positioned in a pouch 70 made of two plies 70*a*, 70*b* of material. In one embodiment the ply 70*a* of the pouch 70 facing the other magnet 66 or magnetizable component is an outer shell material 26, and the material of the other ply 70*b* of the pouch 70 (facing away from the other magnet or magnetizable component) is made of foam, such as an open cell foam in one case. Because the outer ply 70*b*, when made of foam, may be relatively bulky, arranging the pouches 70 such that the outer ply 70*b* is not positioned between the magnets 66 or magnetizable components can help to reduce the spacing and thereby provide increased magnetic attraction between the magnets 66 or magnetizable components. However, it should be understood that the pouches 70 can be made of any wide variety of materials and configured in various manners.

In one embodiment, each magnet 66 is positioned adjacent to/magnetically coupled to an associated backing member or disc 74 that is located in the pouch 70. Each disc 74 can be made of ferrous or magnetizable material in the same manner as outlined above for the magnetizable components. The discs 74 can help in manufacturing/locating of the associated magnet 66 in the desired position. Each disc 74 may also provide a shunting force to direct the magnetic field away from the wearer 45 (in the case of the fixed collar retaining component 59) and/or toward the other magnet 66 or magnetizable component (in the case of the protective collar retaining component 57 and fixed collar retaining component 59) to increase the magnetic attraction. Each disc 74 can have a size and shape (in front view) that generally corresponds to a size and/or shape of the corresponding magnet 66. However, it should be understood that the discs 74 are optional. The magnets 66 and/or discs 74 and/or magnetizable components can be secured in place in the pouches 70 by a variety of methods, such as an adhesive and/or stitching that extends through the pouch 70 and extends around each magnet 66/disc 74/magnetizable component to essentially lock the component in place and limit the motion/travel thereof.

Each of the magnets 66, in the illustrated embodiment, are generally flat and circular in front view, taking the form of "button" magnets, with their poles oriented perpendicular to the flat end surfaces. However, the magnets 66 can have any wide variety of shapes and configurations. The magnets 66 may in one case have a pull force (either magnet-to-magnet or magnet-to-magnetizable component) of between about 10 lbs. and about 20 lbs. at a distance of 0 inches, and between about 0.5 lbs. and about 5 lbs. at a distance of 0.2 inches. In one case, the pull force provided by the magnets 66, when the protective collar 50/tab 52 is in the engaged position, is selected to be similar to the pull force required to open typical hook-and-loop fasteners used in firefighter turnout gear. The magnets 66 can be permanent magnets made of various materials, and in one case are rare earth magnets, such as neodymium magnets (in one case N48 magnets or 48 MGO megagauss oersteds magnets) with a nickel coating.

In addition, it should be understood that the retaining components 57, 59 can include or take the form of various other mechanisms or mechanisms, besides magnets, for securing the protective collar 50/tab 52 and fixed collar 34 to each other and/or retaining the protective collar 50/tab 52 in the extended position, such as hook-and-loop material (e.g. VELCRO® material), snaps, clasps, snaps, buttons or the like. In addition, one or both of the retaining components 57, 59 can include or take the form of material or components, such as hook-and-loop fastening material, that extends continuously or discontinuously in the circumferential direction (e.g. along at least about 10% of the length of the protective collar 50/tab 52 in one case, or at least about 20% in another case, or at least about 40% in yet another case) to provide flexibility in size/fit adjustments when the protective collar 50/tab 52 is engaged, similar to that shown in FIGS. 5-7.

Figure 10:
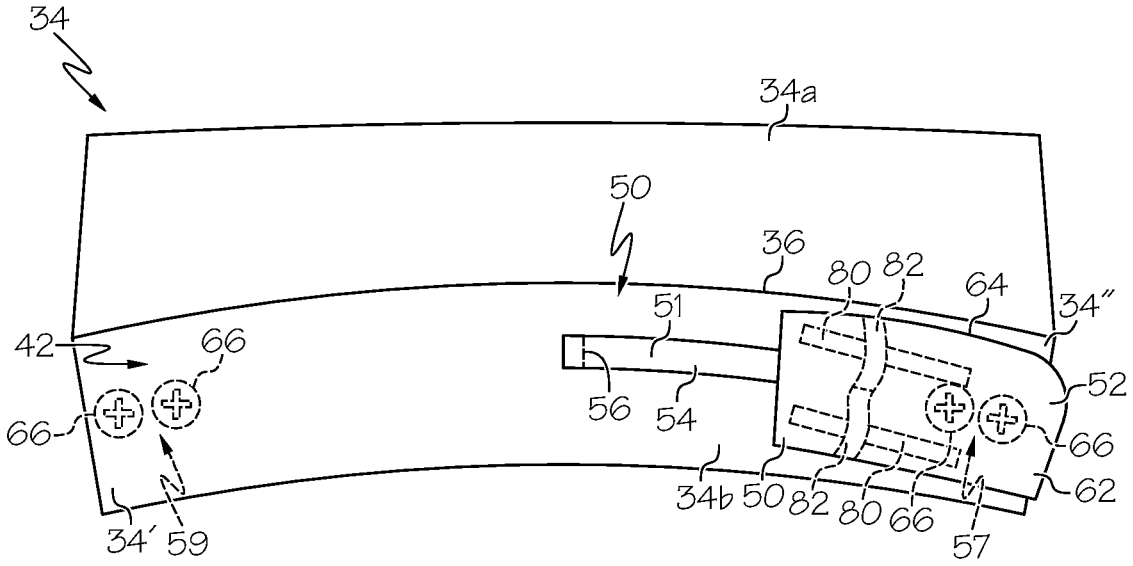
FIG. 10 is a front perspective view of the collar area of the coat of FIG. 1, with the inner ply of the fixed collar folded upwardly to reveal the protective collar.

In one case, however, the retaining components 57, 59 do not include or take the form of buttons, and in this case the protective collar 50/tab 52 (and tabs 52*a*, 52*b* described below) and/or fixed collar 34 can each lack any buttons and/or button holes. In some cases buttons may be too difficult to operate and/or the button holes may undesirably compromise the strength and protection provided by the associated components. In one case the retaining components 57, 59 can be positioned entirely internally to the protective collar 50/tab 52 and/or the tabs 52, 52*a*, 52*b* and/or the collar 34, and entirely spaced away and not intersecting the outer surfaces thereof, to enable a smooth, continuous outer surface to be provided to those components to enable smooth sliding thereof and prevent other components or equipment from catching thereon. It should be noted that while FIG. 10 shows the protective collar 50/tab 52 and the fixed collar retaining component 59 mounted on the inner ply 34*b*, one or both of the protective collar 50/tab 52 and the fixed collar retaining component 59 can be positioned on the outer ply 34*a*.

Figure 19:
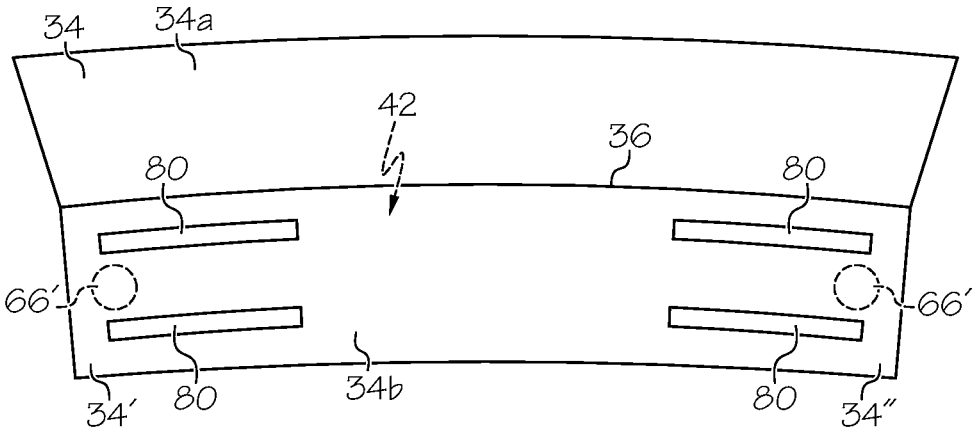
FIG. 19 shows the collar of FIG. 18, with the protective collar portions removed.
Figure 20:
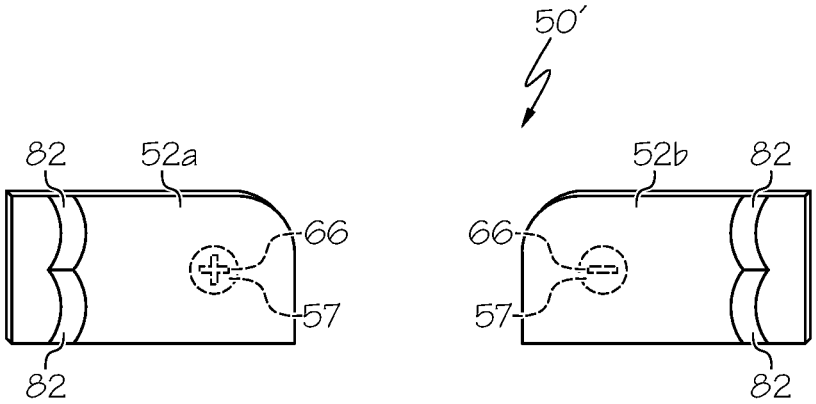
FIG. 20 shows the protective collar portions of FIG. 18.

In one case the protective collar 50/tab 52 and/or fixed collar 34 can include various features to guide the movement of the protective collar 50/tab 52 between its extended and retracted positions. In particular, as shown in FIG. 10, in one embodiment the inner ply 34*b* of the fixed collar 34 includes a guide portion in the form of two strip or loops of material 80 and extending in the circumferential direction. In particular in one case each loop 80 is positioned on the inner/front side of the inner ply 34*b* of fixed collar 34 and secured thereto only at its distal ends (see also the analogous components 80 in FIG. 19). The inner/back side of the protective collar 50/tab 52 can include a corresponding guide portion in the form of a pair of loops/strips of material 82 extending in the vertical direction relative to the frame of reference of the wearer 45 (or in the axial direction), which are secured at their distal ends (see analogous components in FIG. 20).

In this manner the loops 82 of the protective collar 50/tab 52 can receive the loops 80 of the fixed collar 34 therethrough/thereunder and be secured in place. The inter-engaging loops 80, 82 cooperate to guide and limit the sliding/translation movement of the protective collar 50/tab 52. However, it should be understood that any of a wide variety of guides, inter-engaging shapes or the like can be used to guide the sliding motion of the protective collar 50/tab 52 or, if desired, no guiding structures at all may be utilized. For example, in one case, the elastic component 54 can take the form of a relatively wide elastic component 54 (see FIGS. 3, 4, 12 and 13, in contrast to FIGS. 10 and 17 which show a relatively narrow elastic component 54) which can in some cases eliminate the need for a separate guiding structure.

In addition, it should be understood that the biasing mechanism 51 can include or take the form of various other structures or arrangements besides the elastic component 54 to bias or retract the protective collar 50/tab 52 to its retracted position. For example, in one case, as shown in FIG. 7, the biasing mechanism 51 can include or take the form of a magnet or pair of magnets or magnetizable components 66' can be positioned at distal ends 34' of the fixed collar 34, which are magnetically attracted to the magnets 66/magnetizable components of the protective collar 50/tab 52. In addition, various other structures, such as a drawstring that is secured to the protective collar 50/tab 52 that can be manually pulled by the wearer 45, can be implemented as and/or in place of the biasing mechanism 51 to enable the protective collar 50/tab 52 to return its retracted position. The biasing mechanism 51 can also include any of a variety of other mechanisms or arrangements, such as springs, deformable materials, etc.

In the embodiment of FIGS. 1-10, the protective collar 50 includes or takes the form of single tab 52. In contrast, in the embodiment of FIGS. 11-20, the protective collar or protective collar component 50' includes or take the form of a pair of tabs 52*a*, 52*b*, in one case coupled to opposed ends of an elastic component 54. The tabs 52*a*, 52*b* can also be termed a first protective collar component portion 52*a* and a second or supplemental protective collar component portion 52*b*, respectively. As shown in FIG. 17, in one embodiment a single elastic component 54 is coupled to both tabs 52*a*, 52*b*, and is also secured to the collar 34 and tabs 52*a*, 52*b* by stitching 56. Alternatively, rather than using a single elastic component 54, each tab 52 can be coupled to its own, separate elastic component (not shown) that is coupled to the fixed collar 34; in this case the elastic component can, if desired, be considered as a single "discontinuous" elastic component. The tabs 52*a*, 52*b* can be elastically coupled together at a location along the sides/back of the coat 10 and/or spaced away from the center line 23 and/or gap 44. Each tab 52*a*, 52*b* of the protective collar 50' may have a vertical height, material properties, and other qualities that are the same as the protective collar 50/tab 52 as outlined above.

Figure 11:
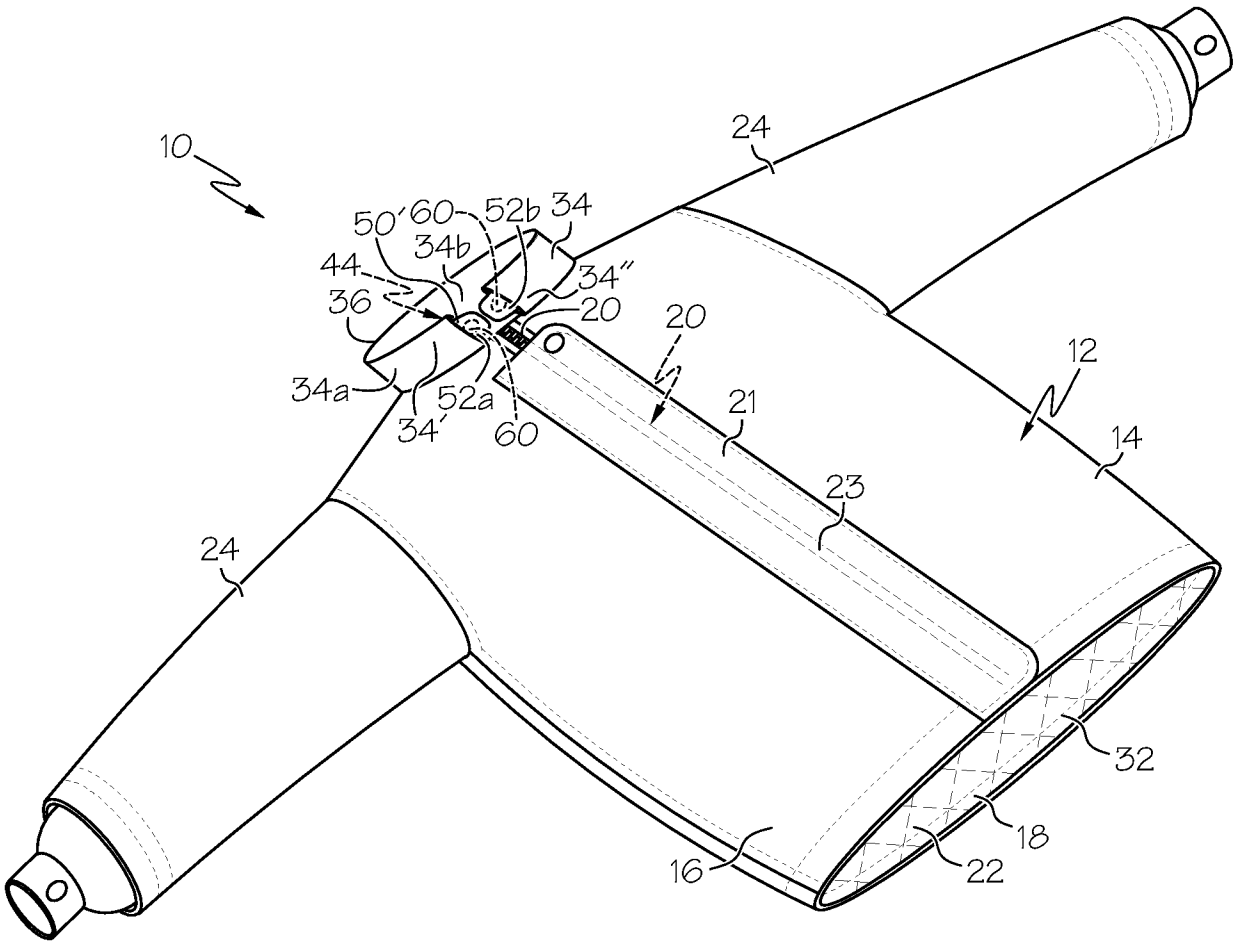
FIG. 11 is a front perspective view of a coat with an alternate embodiment of the protective collar, with the protective collar in a retracted position.
Figure 12:
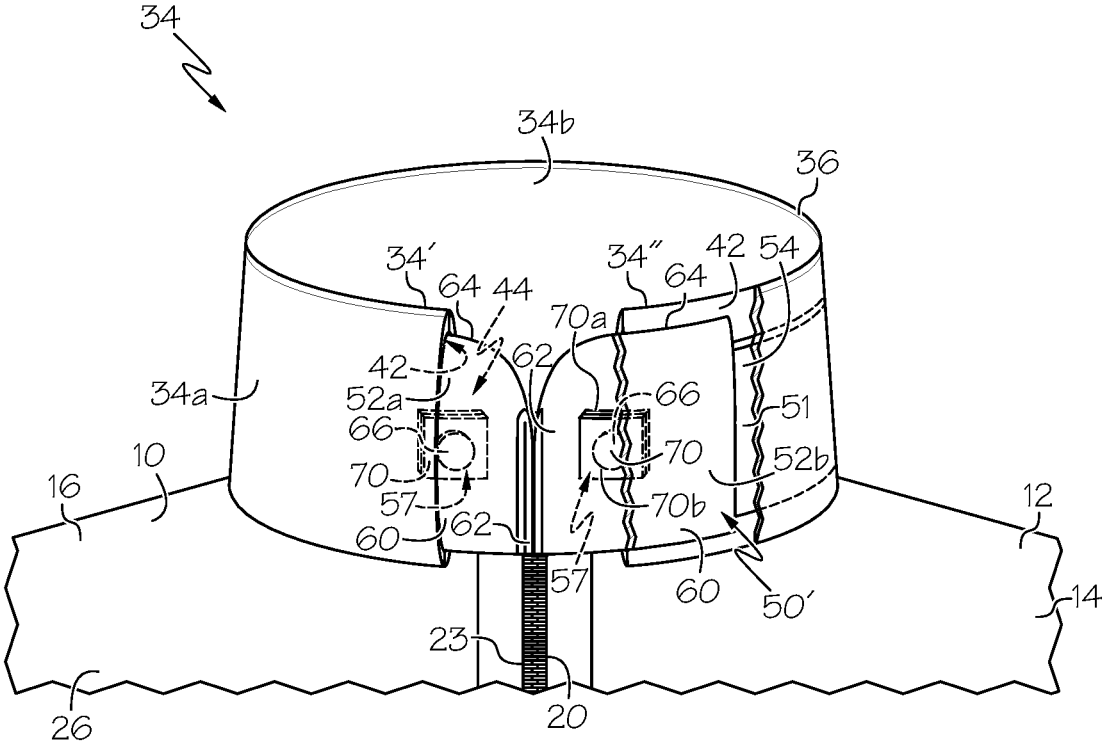
FIG. 12 is a detail perspective of the collar area of the coat of FIG. 11, with the protective collar in a partially extended position with portions of the fixed collar and the protective collar cut away.

The protective collar 50' and/or each tab 52*a*, 52*b* is positionable in a first, retracted or disengaged position (e.g. when the fastener 20 of the coat 10 is fully fastened), as shown in FIG. 11, wherein the elastic component 54 is at rest and not under tension (or is under a relatively low level of tension). When in the retracted position the tabs 52*a*, 52*b* may not overlap and/or may not extend fully across the center line 23 or gap 44, and the tabs 52*a*, 52*b* are relatively retracted and can have the same qualities when in the retracted position as the single tab embodiment described above. Thus when the protective collar 50' and/or tabs 52 are in the retracted position, at least part of one or both tabs 52*a*, 52*b* may be positioned in the cavity 42 of the collar 34 (in one case, in the same proportions as the tab 52 described above), and in the illustrated embodiment at least part of each tab 52*a*, 52*b* protrudes outwardly from the cavity 42 and at least partially extends across the gap 44. However, in some embodiments the tabs 52*a*, 52*b* (and the protective collar 50') can be retracted entirely into the cavity 42 and may not be visible when in the retracted position.

Figure 13:
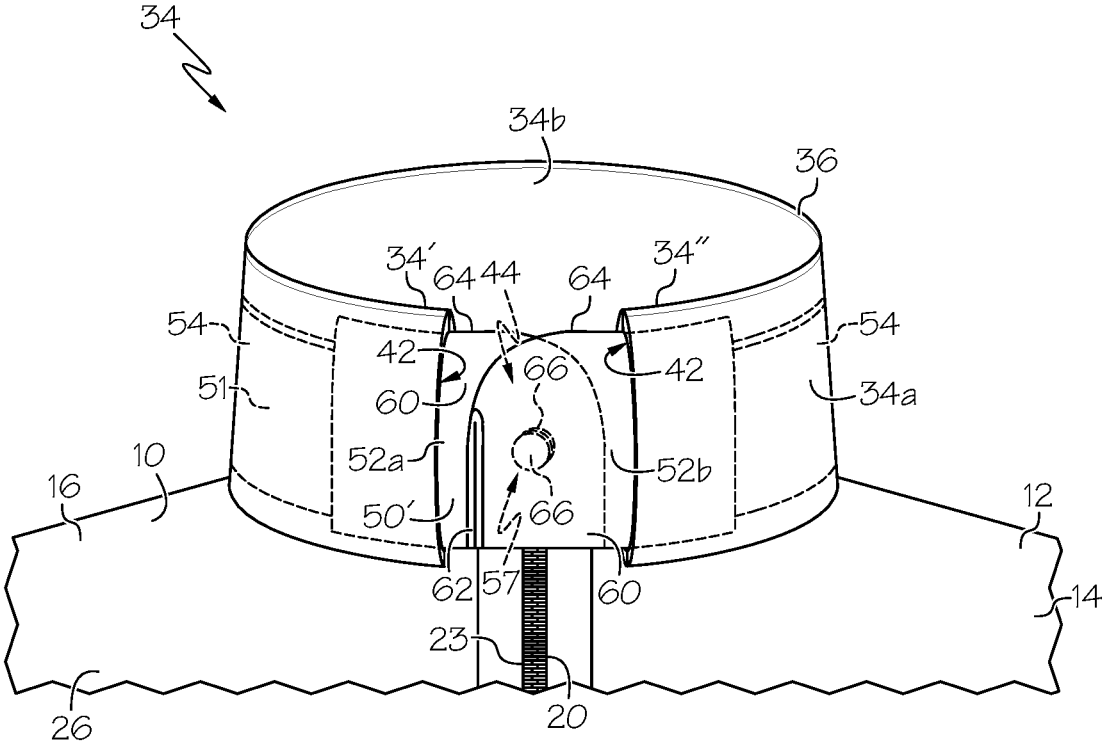
FIG. 13 shows the collar area of FIG. 12, with the protective collar in an extended position.
Figure 14:
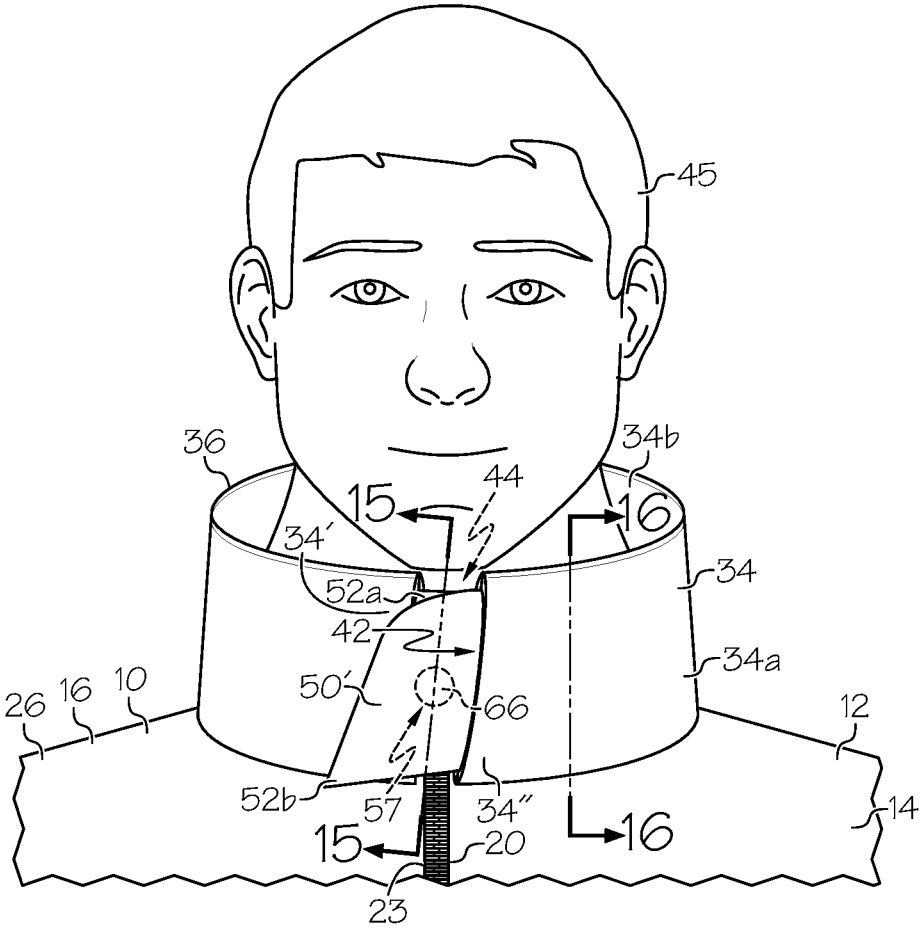
FIG. 14 is a front view of the collar area of FIG. 12, showing another embodiment of the protective collar in an extended position.

The protective collar 50' and/or each tab 52*a*, 52*b* is also movable to a second, extended or engaged position (e.g. when the fastener 20 of the coat 10 is fully fastened), as shown in FIGS. 13 and 14 (in one case, in the same proportions as the tab 52 described above). In the extended position, the protective collar 50' and/or tabs 52*a*, 52*b* can extend further circumferentially as compared to when in the retracted position, and in one case the protective collar 50' and/or two tabs 52*a*, 52*b* together entirely extend across and/or cover the center line 23/gap 44. In the embodiment of FIGS. 13 and 14, when the protective collar 50' is in its extended position, the tabs 52*a*, 52*b* at least partially overlap in the radial direction, such that one of the tabs 52 (tab 52*b*, in the illustrated embodiment) is positioned radially outside the other tab 52 (tab 52*a*, in the illustrated embodiment).

When in the extended position, at least part of each tab 52*a*, 52*b* may remain in the cavity 42 to provide more complete protection to the wearer 45. In addition, when in the extended position at least part of the protective collar 50' and/or each tab 52*a*, 52*b* is positioned in the front/center of the coat 10, aligned with and/or spanning (in the circumferential direction) the fastener 20 and/or center line 23 in one case.

When the protective collar 50' (or at least one of the tabs 52*a*, 52*b*) is in the extended position, the elastic component 54 (when used as the biasing mechanism 51) is placed in tension and thereby desires to pull or return the protective collar 50'/tabs 52*a*, 52*b* to their retracted positions. In this manner, when the retaining components 57, 59 are released, the tabs 52*a*, 52*b* may automatically return to their retracted position as shown in FIG. 11, and are thereby biased to their retracted positions.

As noted above, in one case each tab 52*a*, 52*b* can include a protective collar retaining component 57, such as in the form of a magnet 66 and/or magnetizable portion positioned in each tab 52*a*, 52*b* such that each tab 52*a*, 52*b* is magnetically attracted to the other tab 52*a*, 52*b* to thereby retain the tabs 52*a*, 52*b*, and the protective collar 50', in its extended position. In this case, the tabs 52*a*, 52*b* can overlap when in the extended position and when coupled together. In one case, each tab 52*a*, 52*b* includes a permanent magnet 66 positioned therein, although if desired only one of the tabs 52*a*, 52*b* can include a magnet 66, and the other one of the tabs 52*a*, 52*b* can include a magnetizable component (not shown) made of a magnetizable material that is not a permanent magnet, such as ferrous metal. In the illustrated embodiment, each tab 52*a*, 52*b* includes only a single magnet 66/magnetizable component, but can include two or more magnets 66/magnetizable components, as described above in the embodiment of FIGS. 1-10.

The tabs 52*a*, 52*b* can be arranged such that when they are in their extended position, the magnet 66 of the outer tab 52*b* is configured such that its inwardly-facing face has an opposite pole orientation to the outwardly-facing face of the magnet 66 of the inner tab 52*a*. Thus, when the tabs 52*a*, 52*b* are moved to their extended positions, the magnets 66 magnetically interact and couple with a force greater than that imparted by the elastic component 54 (or other biasing force, if utilized) thereby retaining the tabs 52*a*, 52*b* in their extended positions. If one of the tabs 52*a*, 52*b* has a magnetizable component instead of a magnet 66, the magnet 66 of the other tab 52*a*, 52*b* may be arranged in any desired configuration or orientation.

Figure 15:
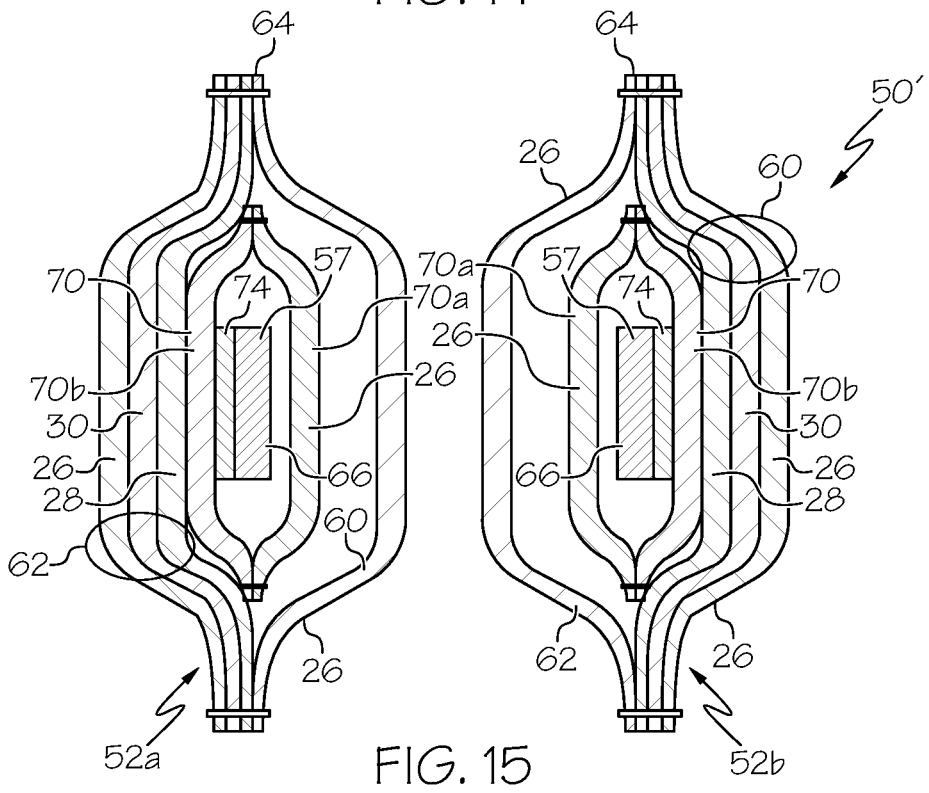
FIG. 15 is a cross-section of the protective collar taken along line 15-15 of FIG. 14.

As shown in FIG. 15, the outer ply 60 of the outer tab 52*b* can include more protective layers than the inner ply 62 of that tab 52*b*. For example, the outer ply 60 of the outer tab 52*b* can include layers of outer shell 26, thermal barrier 30 and moisture barrier 28 material, and the inner ply 62 of the outer tab 52*b* can include only outer shell material 26. Conversely, the outer ply 60 of the inner tab 52*a* can include less layers than the inner ply 62 of that tab 52*a*. In particular, the outer ply 60 of the inner tab 52*a* can include only outer shell material 26, and the inner ply 62 of the inner tab 52*a* can include layers of outer shell 26, thermal barrier 30 and/or moisture barrier 28 material.

This combination of layers provides sufficient protection to the wearer 45, and can provide protection at least equal to that provided by the fixed collar 34. However by positioning the protective layers of the tabs 52*a*, 52*b* in this configuration, there are less layers, and thereby less distance/interference, between the cooperating magnets 66 (or magnet and magnetizable component) positioned in the tabs 52*a*, 52*b* to ensure the magnets 66 (or magnetizable component) are properly magnetically engaged to retain the protective collar 50'/tabs 52*a*, 52*b* in the extended position. In this manner there are less layers and/or thickness between the inner (facing) side or surfaces of the magnets 66/magnetizable components than on the outer sides or surfaces. Nevertheless it should be understood that each ply 60, 62 of each tab 52*a*, 52*b* can have various layers and construction as desired.

With reference to FIG. 15, in one embodiment each of the magnets 66 or magnetizable components is positioned in a pouch 70 as outlined above in the context of the embodiment of FIG. 1-10. Moreover, if desired each magnet 66 can be is positioned adjacent to/magnetically coupled to an associated backing member or disc 74 as outlined above. In addition, it should be understood that the protective collar retaining component 57 can take the form of various other mechanisms or arrangements for securing the tabs 52*a*, 52*b* to each other as outlined above in the context of the embodiment of FIGS. 1-10. Each protective collar retaining component 57 can include two magnets or strips of hook-and-loop fastener, or other fastening devices, as outlined above to enable the tabs 52*a*, 52*b* can be coupled together at various overlapping positions (e.g. tighter or looser) to adjust the protective collar 50' to the desired fit. Moreover, the protective collar 50' and/or collar 34 can include various features to guide the movement of the protective collar 50'/tabs 52*a*, 52*b* between its extended and retracted positions. In addition, it should be understood that various structures or arrangements besides the elastic component 54 can be used to retract the tabs 52*a*, 52*b* to their retracted position.

Figure 16:
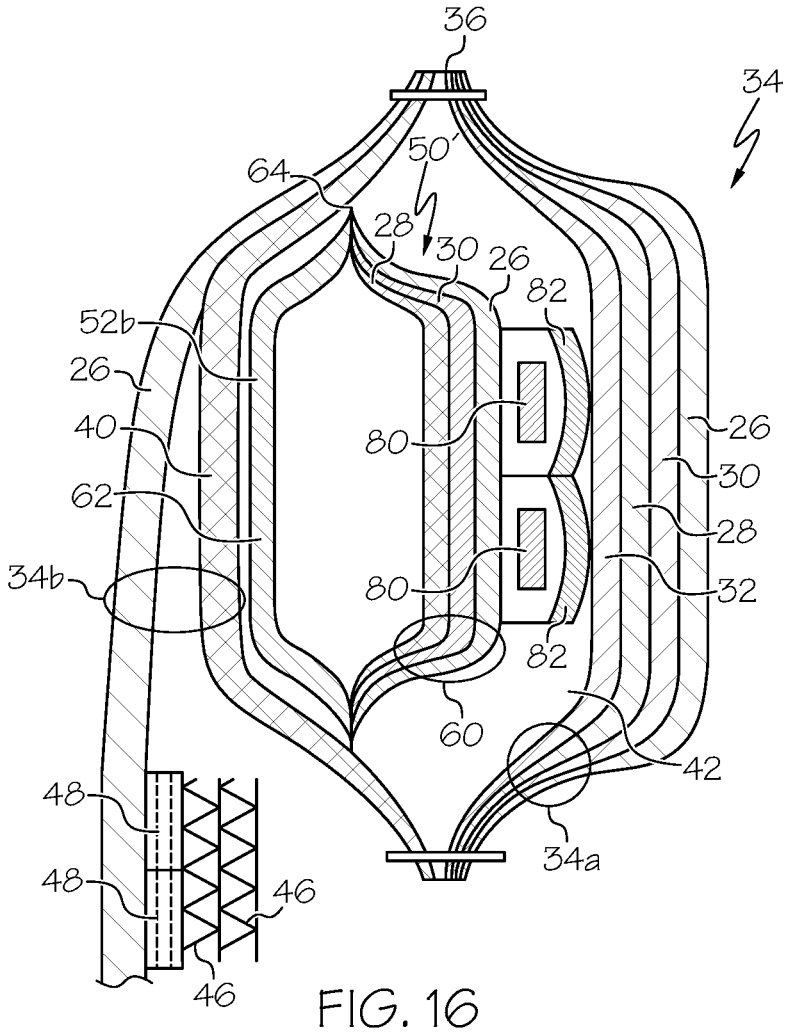
FIG. 16 is a cross-section of the collar taken along line 16-16 of FIG. 14.
Figure 17:
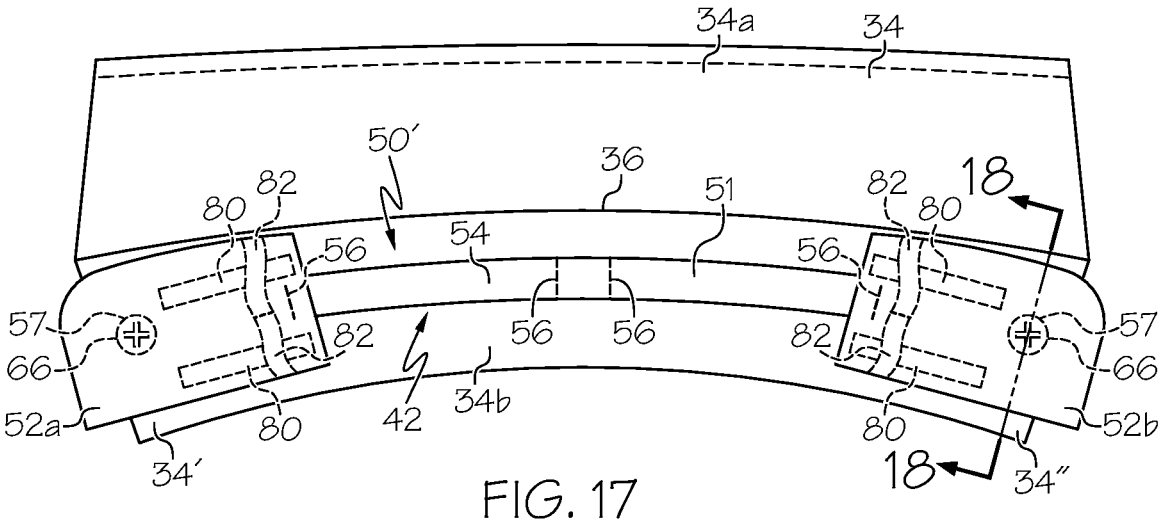
FIG. 17 is a front perspective view of the collar area of the coat of FIG. 11, with the inner ply of the fixed collar folded upwardly to reveal the protective collar.
Figure 18:
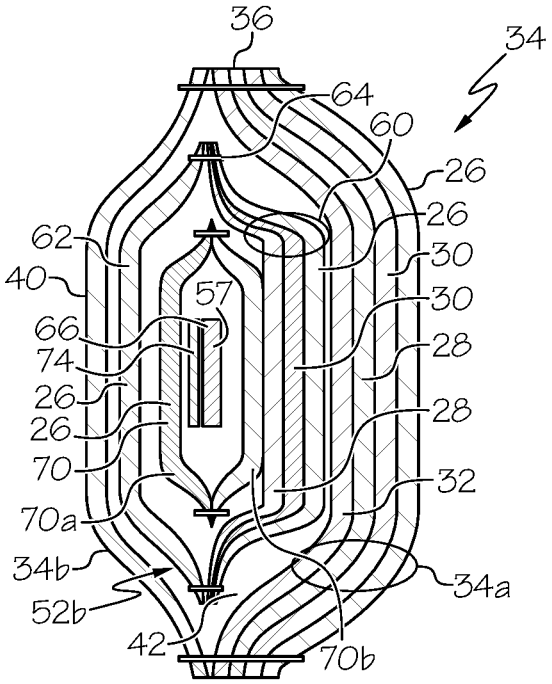
FIG. 18 is a cross-section of the collar taken along line 18-18 of FIG. 17, when the inner ply is folded downwardly.

As shown in FIG. 16, the fixed collar 34/inner ply 34*b* can be coupled to a relatively short liner collar 46 of the thermal barrier 30 and/or moisture barrier 28 that is coupled to or forms part of the body portion 12 of the coat 10. In the illustrated embodiment the inner ply 34*b* is coupled to the liner collar 46 by a zipper 48. For example, the upper one of the zippers 48 can be coupled to the fixed collar 34, and the lower one of the zippers 48 can be coupled to the liner collar 46, and the zippers 48 can be releasably coupled together along their lengths. The same coupling mechanism shown in FIG. 16 can also be used in the embodiment of FIGS. 1-10.

In the embodiment shown in FIGS. 16, the inner ply 34*b* of the collar 34 includes or is made of a layer of outer shell material 26 and optionally a mesh material 40 such as a very fine fabric which can be generally transparent or translucent, and which is water permeable. For example, the mesh material 40 can have an average hole size of at least about 3 $mm^2$ in one case. By making the inner ply 34*b* and/or part thereof to be water permeable material, the protective collar 50/tab 52 is made easier to clean by, for example, washing machines since water can permeate through the inner ply 34*b* into the cavity 42. The same arrangement for the inner ply 34*b* can also be used in the embodiment of FIGS. 1-10.

The protective collar 50, 50' can provide protection to a wearer 45 of the coat 10 across the front of their throat and span/close the gap 44 to provide continuous protection. The protective collar 50, 50' is durable, robust and intuitive to use, and can be easily operated by a wearer 45. In addition, the retaining components 57, 59 or other retainer system can be operated without fine motor skills, which can provide ease of use to a wearer 45 who is wearing gloves and/or when time is limited, to ensure sufficient protection.

Having described the invention in detail and by reference to the preferred embodiments, it will be apparent that modifications and variations thereof are possible without departing from the scope of the invention.

What is claimed is:

1. A firefighter coat comprising:

a coat body including an outer shell and a thermal barrier having a TPP of at least about thirty and configured to be positioned between the outer shell and a wearer of the coat;

a fixed collar coupled to the coat body and configured to extend generally circumferentially when the coat is worn, the fixed collar having a fixed collar retaining component; and a protective collar that is movable between a retracted position wherein at least part of the protective collar is positioned in the fixed collar, and an extended position wherein less of the protective collar is positioned in the fixed collar than when the protective collar is in the retracted position, wherein the protective collar is configured to move in a generally circumferential direction when moving between the extended position and the retracted position, and wherein the protective collar has a protective collar retaining component that is configured to interact with the fixed collar retaining component to releasably retain the protective collar in the extended position.

2. The coat of claim 1 wherein the coat has a center line, and wherein the protective collar is configured to be entirely positioned on a first side of the center line when the protective collar is in the retracted position when the coat is worn, and to be at least partially positioned on a second, opposite side of the center line when the protective collar is in the extended position.

3. The coat of claim 1 wherein the coat includes a fastener configured to join opposite panels of the coat together when donning or doffing the coat, and wherein the protective collar is configured to be entirely positioned on a first side of the fastener when the protective collar is in the retracted position when the coat is worn, and to be at least partially positioned on a second, opposite side of the fastener when the protective collar is in the extended position.

4. The coat of claim 1 wherein the coat has a center line, and wherein the protective collar is configured to be entirely positioned on a first side of the center line when the protective collar is in the retracted position when the coat is worn, and wherein the fixed collar retaining component is fixedly coupled to the fixed collar and located on a second, opposite side of the center line.

5. The coat of claim 1 wherein the coat has a center line, and wherein the protective collar is configured to be entirely positioned on a first side of the center line when the protective collar is in the retracted position when the coat is worn, and wherein the coat is configured such that when the protective collar is in the extended position, both the protective collar retaining component and the fixed collar retaining component are entirely positioned on a second side of the center line.

6. The coat of claim 1 wherein the fixed collar has a gap or discontinuity when the coat is worn and in a closed configuration, and wherein the protective collar is configured to be entirely positioned on a first side of the gap or discontinuity when the protective collar is in the retracted position, and to be at least partially positioned on a second, opposite side of the gap or discontinuity when the protective collar is in the extended position.

7. The coat of claim 1 wherein the fixed collar includes first and second end portions, wherein the at least part of the protective collar is positionable in the first end portion and removably attachable to the second end portion of the fixed collar by the protective collar retaining component and the fixed collar retaining component when the protective collar is in the extended position.

8. The coat of claim 1 wherein at least part of the protective collar is positioned radially inside at least part of the fixed collar when the protective collar is in the retracted position.

9. The coat of claim 1 wherein at least part of the protective collar is positioned between an inner ply and an outer ply of the fixed collar when the protective collar is in the retracted position.

10. The coat of claim 1 wherein the protective collar is removably attachable to an outermost surface of the fixed collar by cooperation between the protective collar retaining component and the fixed collar retaining component, when the protective collar is in the extended position and when the coat is worn.

11. The coat of claim 1 wherein the fixed collar retaining component is fixedly coupled to the fixed collar and is not translatable relative to the fixed collar.

12. The coat of claim 1 wherein at least about 80% of a length of the protective collar in the circumferential direction is positioned in the fixed collar when the protective collar is in the retracted position, and wherein at least about 30% of the length of the protective collar is not positioned in the fixed collar when the protective collar is in the extended position.

13. The coat of claim 1 wherein at least one of the protective collar retaining component or the fixed collar retaining component is a magnet, and wherein the other one of the protective collar retaining component or the fixed collar retaining component is a magnet or a magnetizable component.

14. The coat of claim 13 wherein each magnet or magnetizable component of the fixed collar retaining component or the protective collar retaining component is positioned in the associated one of the fixed collar or the protective collar and are configured to magnetically engage each other on an inner side thereof, and wherein at least one of the fixed collar or protective collar has a lesser thickness positioned on an inner side of the associated magnet or magnetizable component as compared to an outer side of the magnet or magnetizable component.

15. The coat of claim 1 wherein the protective collar is biased to the retracted position.

16. The coat of claim 15 wherein the coat includes an elastic component coupled to the protective collar and to the fixed collar, and configured such that when the protective collar is in the extended position the elastic component is in tension.

17. The coat of claim 1 wherein the fixed collar defines a generally circumferentially-extending cavity therein when the coat is worn, the cavity extending an entire height of the protective collar, and wherein at least part of the protective collar is positioned in the cavity when the protective collar is in the retracted position.

18. The coat of claim 1 wherein the protective collar and fixed collar each include a guide portion configured to interact with each other to guide the protective collar when the protective collar moves between the extended and the retracted positions.

19. The coat of claim 1 wherein the protective collar is configured to move in a translation motion when moving between the retracted and extended positions.

20. The coat of claim 1 wherein the protective collar is movable to a supplemental extended position when the coat is worn, and wherein the protective collar retaining component and fixed collar retaining component are configured to interact with each other to retain the protective collar in the supplemental extended position.

21. The coat of claim 1 wherein the coat includes a moisture barrier configured to permit moisture vapor to pass therethrough but block liquids from passing therethrough, wherein the moisture barrier is configured to be positioned between the outer shell and a wearer of the coat.

22. The coat of claim 1 wherein the protective collar is configured to move in a circumferential direction, extending circumferentially about a perimeter of the fixed collar, when moving between the extended position and the retracted position.

23. The coat of claim 1 wherein the fixed collar retaining component is not a button hole.

24. A coat comprising:

a coat body having at least one of a center line, or a fastener configured to join opposite panels of the coat together when donning or doffing the coat;

a fixed collar coupled to the coat body and configured to extend generally circumferentially when the coat is worn, wherein the fixed collar is fixedly coupled to the coat body; and a protective collar that is movable between a retracted position wherein the protective collar is configured to be entirely positioned on a first side of at least one of the center line or the fastener, and an extended position wherein at least part of the protective collar is positioned on a second, opposite side of the at least one of the center line or fastener, wherein the protective collar is configured to translate in a generally circumferential direction when moving between the extended position and the retracted position.

25. The coat of claim 24 wherein the fixed collar has a fixed collar retaining component, and wherein the protective collar has a protective collar retaining component that is configured to interact with the fixed collar retaining component when the coat is worn to retain the protective collar in the extended position.

26. The coat of claim 24 wherein at least part of the protective collar is positioned in the fixed collar when the protective collar is in the retracted position.

27. The coat of claim 24 wherein at least part of the protective collar is positioned between an inner ply and an outer ply of the fixed collar when the protective collar is in the retracted position, and wherein the coat body includes an outer shell and a thermal barrier having a TPP of at least about thirty and configured to be positioned between the outer shell and a wearer of the coat.

28. A coat comprising:

a coat body;

a fixed collar coupled to the coat body and configured to extend generally circumferentially when the coat is worn; and at least one protective collar that is movable between a retracted position wherein at least part of the protective collar is positioned in the fixed collar, and an extended position wherein less of the protective collar is positioned in the fixed collar than when the protective collar is in the retracted position, wherein the protective collar is configured to move in a generally circumferential direction when moving between the extended position and the retracted position, and wherein the protective collar has a protective collar retaining component positioned entirely internally thereto that is configured to interact with another protective collar retaining component to releasably retain the protective collar in the extended position.

29. The coat of claim 28 wherein the protective collar retaining component is at least one of a magnet or a magnetizable component.

30. The coat of claim 28 wherein the another protective collar retaining component is a fixed collar retaining component directly and immovably coupled to the fixed collar.

31. The coat of claim 28 further comprising a supplemental protective collar that is movable between a retracted position wherein at least part of the supplemental protective collar is positioned in the fixed collar, and an extended position wherein less of the supplemental protective collar is positioned in the fixed collar than when the supplemental protective collar is in the retracted position, wherein the another protective collar retaining component is a supplemental collar retaining component directly coupled to the supplemental protective collar.

32. The coat of claim 28 wherein at least part of the protective collar is positioned between an inner ply and an outer ply of the fixed collar when the protective collar is in the retracted position, and wherein the coat body includes an outer shell and a thermal barrier having a TPP of at least about thirty and configured to be positioned between the outer shell and a wearer of the coat.

* * * * *